US009493865B2

(12) United States Patent
Kami et al.

(10) Patent No.: US 9,493,865 B2
(45) **Date of Patent: *Nov. 15, 2016**

(54) THICK-WALLED HIGH-STRENGTH HOT ROLLED STEEL SHEET WITH EXCELLENT LOW-TEMPERATURE TOUGHNESS AND METHOD OF PRODUCING SAME

(71) Applicant: JFE Steel Corporation, Tokyo (JP)

(72) Inventors: Chikara Kami, Tokyo (JP); Hiroshi Nakata, Tokyo (JP); Kinya Nakagawa, Tokyo (JP)

(73) Assignee: JFE Steel Corporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/635,053

(22) Filed: Mar. 2, 2015

(65) Prior Publication Data

US 2015/0176110 A1 Jun. 25, 2015

Related U.S. Application Data

(62) Division of application No. 13/056,791, filed as application No. PCT/JP2009/063981 on Jul. 31, 2009, now abandoned.

(30) Foreign Application Priority Data

| | | |
|---|---|---|
| Jul. 31, 2008 | (JP) | 2008-198314 |
| Jan. 30, 2009 | (JP) | 2009-019345 |
| Jan. 30, 2009 | (JP) | 2009-019351 |
| Jan. 30, 2009 | (JP) | 2009-019352 |

(51) Int. Cl.
*C21D 8/02* (2006.01)
*C22C 38/58* (2006.01)

(Continued)

(52) U.S. Cl.
CPC ..... *C22C 38/58* (2013.01); *C21D 1/25* (2013.01); *C21D 6/001* (2013.01); *C21D 6/002* (2013.01); *C21D 6/004* (2013.01); *C21D 6/005* (2013.01);

(Continued)

(58) Field of Classification Search
CPC ..... C21D 8/02
USPC ..... 148/320, 332–337, 503–507, 602
See application file for complete search history.

(56) References Cited

U.S. PATENT DOCUMENTS 5,853,503 A 12/1998 Seto et al.
6,695,932 B2 2/2004 Kami et al.

(Continued)

FOREIGN PATENT DOCUMENTS

EP 1 325 967 A1 7/2003
EP 1 462 535 A1 9/2004

(Continued)

OTHER PUBLICATIONS

B. Mishra, "Steelmaking Practices and Their Influence on Properties," ASMHandbook, ASM International, 2002.

(Continued)

*Primary Examiner* — Brian Walck
(74) *Attorney, Agent, or Firm* — DLA Piper LLP (US)

(57) ABSTRACT

A thick-walled high-strength hot rolled steel sheet has a high tensile strength TS of 521 MPa or more and excellent low-temperature toughness. The steel material forming the sheet contains 0.02%-0.08% C, 0.01%-0.10% Nb, and 0.001%-0.05% Ti and is heated; C, Ti, and Nb satisfies (Ti+(Nb/2))/C<4.

16 Claims, 5 Drawing Sheets

(51) Int. Cl.

| | |
|---|---|
| ***C21D 1/25*** | (2006.01) |
| ***C21D 9/08*** | (2006.01) |
| ***C22C 38/00*** | (2006.01) |
| ***C22C 38/12*** | (2006.01) |
| ***C22C 38/14*** | (2006.01) |
| ***C21D 6/00*** | (2006.01) |
| ***C21D 9/46*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/16*** | (2006.01) |
| ***C22C 38/26*** | (2006.01) |
| ***C22C 38/28*** | (2006.01) |
| ***C22C 38/38*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| *C21D 11/00* | (2006.01) |

(52) U.S. Cl.

CPC ..... *C21D 6/008* (2013.01); *C21D 8/02* (2013.01); *C21D 8/0226* (2013.01); *C21D 8/0263* (2013.01); *C21D 9/085* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/26* (2013.01); *C22C 38/28* (2013.01); *C22C 38/38* (2013.01); *C22C 38/42* (2013.01); *C22C 38/44* (2013.01); *C22C 38/46* (2013.01); *C22C 38/48* (2013.01); *C22C 38/50* (2013.01); *C21D 11/005* (2013.01); *C21D 2211/002* (2013.01); *C21D 2211/005* (2013.01); *C21D 2211/008* (2013.01)

(56) References Cited

U.S. PATENT DOCUMENTS

| | | | |
|---|---|---|---|
| 6,702,904 | B2 | 3/2004 | Kami et al. |
| 6,899,771 | B2 | 5/2005 | Kami et al. |
| 6,902,632 | B2 | 6/2005 | Kami et al. |
| 7,101,445 | B2 | 9/2006 | Kami et al. |
| 7,501,030 | B2 | 3/2009 | Nakata et al. |
| 7,879,287 | B2 | 2/2011 | Kobayashi et al. |
| 2005/0183798 | A1 | 8/2005 | Kobayashi et al. |

FOREIGN PATENT DOCUMENTS

| | | | |
|---|---|---|---|
| EP | 1 568 792 | A1 | 8/2005 |
| JP | 64-025916 | A | 1/1989 |
| JP | 4-021719 | A | 1/1992 |
| JP | 8-319538 | A | 12/1996 |
| JP | 9-296216 | A | 11/1997 |
| JP | 11-080833 | A | 3/1999 |
| JP | 2000-160245 | A | 6/2000 |
| JP | 2001-207220 | A | 7/2001 |
| JP | 2001-240936 | A | 9/2001 |
| JP | 2001-286927 | A | 10/2001 |
| JP | 2004-315957 | A | 11/2004 |
| JP | 2005-240051 | A | 9/2005 |
| JP | 2005-281838 | A | 10/2005 |
| JP | 2006-299415 | A | 11/2006 |
| JP | 2007-138290 | A | 6/2007 |
| JP | 2008-056962 | A | 3/2008 |

OTHER PUBLICATIONS

Eigenschaften und Anwendungen von Stählen, Band 1: Grundlagen, 1993 Institut für Eisenhüttenkunde der RWTH Aachen.

F. Gerdemann et al., "Metallographic Characterization of Bainitic Microstructures," International Conference on New Developments in Advanced High-Strength Sheet Steels, Jun. 15-18, 2008, Orlando, Florida, USA.

Renáta Viščorová, "Untersuchung des Wärmeübergangs bei der Spritzwasserkühlung unter Berücksichtigung des Einflusses der Verzunderung," Institut für Metallurgie, 2007.

Anne Purcell, "Mathematical Modelling of Temperature Evolution in the Hot Rolling of Steel," Department of Mining and Metallurgical Engineering, McGill University, Montreal, Canada, May 2000.

THICK-WALLED HIGH-STRENGTH HOT ROLLED STEEL SHEET WITH EXCELLENT LOW-TEMPERATURE TOUGHNESS AND METHOD OF PRODUCING SAME

RELATED APPLICATIONS

This is a divisional of U.S. Ser. No. 13/056,791, filed Jan. 31, 2011, which is a §371 of International Application No. PCT/JP2009/063981, with an international filing date of Jul. 31, 2009 (WO 2010/013848 A1, published Feb. 4, 2010), which is based on Japanese Patent Application Nos. 2008-198314, filed Jul. 31, 2008; 2009-019345, filed Jan. 30, 2009; 2009-019351, filed Jan. 30, 2009; and 2009-019352, filed Jan. 30, 2009.

TECHNICAL FIELD

This disclosure relates to a thick-walled high-strength hot rolled steel sheet suitable as a material for high strength electric resistance welded steel pipes and high strength spiral steel pipes used for transport pipes through which crude oil, natural gas, and the like are transported and which are required to have high toughness, and relates to a method for producing the steel sheet. In particular, the disclosure relates to improvement in low-temperature toughness. Note that the term "steel sheet" includes steel plates and steel strips. The term "high-strength hot rolled steel sheet" used here indicates a hot rolled steel sheet with a high tensile strength (TS) of 510 MPa or more. The term "thick-walled steel sheet" indicates a steel sheet with a thickness of 11 mm or more.

BACKGROUND

In recent years, the exploration of crude oil and natural gas and pipeline construction have been actively performed in very cold regions such as the North Sea, Canada, and Alaska, because of a rise in the price of crude oil, the demand for the diversification of sources of energy allow, and so forth, since the oil crisis. Furthermore, for example, highly corrosive sour gas fields where their developments were once abandoned are actively under way.

For pipelines, high-pressure operation tends to be performed using large-diameter pipes to increase the transport efficiency of natural gas and oil. To withstand high-pressure operation of pipelines, thick-walled steel pipes need to be used as transport pipes. Thus, UOE steel pipes made from thick-walled steel sheets have been increasingly used. Nowadays, however, a strong demand for a further reduction in the cost of pipeline construction, the undersupply of UOE steel pipes, and so forth strongly require a reduction in the material cost of steel pipes. Instead of UOE steel pipes made from thick-walled steel sheets, high strength electric resistance welded steel pipes or high strength spiral steel pipes, which are made from coiled hot rolled steel sheets (hot rolled steel strips) with high productivity and at lower cost, have been increasingly used as transport pipes.

These high strength steel pipes are required to maintain their excellent low-temperature toughness from the viewpoint of preventing the bursting of transport pipes. To produce steel pipes having both high strength and high toughness, for steel sheets serving as materials for steel pipes, attempts have been made to achieve an increase in strength by transformation strengthening using accelerated cooling after hot rolling, precipitation strengthening using precipitates, such as Nb, V, and Ti, of alloy elements, and so forth, and an increase in toughness by forming a finer microstructure using controlled rolling and so forth.

Furthermore, transport pipes used for transporting crude oil and natural gas that contain hydrogen sulfide are required to have excellent sour gas resistance, such as hydrogen induced cracking resistance (HIC resistance) and stress corrosion cracking resistance, in addition to the characteristics, for example, high strength and high toughness.

For such a request, for example, Japanese Unexamined Patent Application Publication No. 08-319538 discloses a method for producing a low yield ratio and high strength hot rolled steel sheet having excellent toughness, the method including the steps of hot-rolling steel that contains, on a mass percent, 0.005% to less than 0.030% C, 0.0002% to 0.0100% B, one or both elements selected from 0.20% or less Ti and 0.25% or less Nb in amounts such that (Ti+Nb/2)/C is 4 or more, and Si, Mn, P, S, Al, and N in appropriate amounts, cooling the steel at a cooling rate of 5 to 20° C./s, coiling the steel at a temperature in the range of higher than 550° C. to 700° C. or lower, whereby the microstructure is composed of ferrite and/or bainitic ferrite, and the amount of solid solution carbon in grains is in the range of 1.0 to 4.0 ppm. The technique described in JP '538 seems to provide a low yield ratio and high strength hot rolled steel sheet having excellent toughness, weldability, and sour gas resistance without causing the nonuniformity of the material in the thickness direction and longitudinal direction. However, in the technique described in JP '538, the amount of solid solution carbon in crystal grains is 1.0 to 4.0 ppm. Hence, heat input during girth welding is disadvantageously liable to cause grain growth. That is, coarse grains are formed in a welded heat affected zone. This is liable to cause a deterioration in the toughness in the welded heat affected zone of a girth welded portion.

Japanese Unexamined Patent Application Publication No. 09-296216 discloses a method for producing a high-strength steel sheet having excellent hydrogen induced cracking resistance, the method including terminating hot rolling of a steel slab at a temperature of $Ar_3$+100° C. or higher, the steel slab containing, on a mass percent, 0.01%-0.12% C, 0.5% or less Si, 0.5%-1.8% Mn, 0.010%-0.030% Ti, 0.01%-0.05% Nb, and 0.0005%-0.0050% Ca to satisfy a carbon equivalent of 0.40 or less and a Ca/O of 1.5 to 2.0; performing air cooling for 1 to 20 seconds; cooling the steel sheet from the $Ar_3$ point or higher to 550° C. to 650° C. in 20 seconds; and coiling the steel sheet at 450° C. to 500° C. The technique described in JP '216 seems to provide a steel sheet for a transport pipe specified by API X60 to X70 grade, the steel sheet having hydrogen induced cracking resistance. However, in the technique described in JP '216, in the case of a steel sheet having a large thickness, a desired cooling time is not ensured. To ensure desired properties, further improvement in cooling capacity is disadvantageously needed.

Japanese Unexamined Patent Application Publication No. 2008-056962 discloses a method for producing a thick high-strength steel plate for a transport pipe having excellent hydrogen induced cracking resistance, the method including heating steel containing, on a mass percent, 0.03%-0.06% C, 0.01%-0.5% Si, 0.8%-1.5% Mn, 0.0015% or less S, 0.08% or less Al, 0.001%-0.005% Ca, and 0.0030% or less O, Ca, S, and O satisfying a specific relationship; performing accelerated cooling at a cooling rate of 5° C./s or more from the $Ar_3$ transformation point to 400° C. to 600° C.; thereafter rapidly reheating the steel plate at a heating rate of 0.5° C./s or more in such a manner that the surface temperature of the steel plate reaches 600° C. or higher and that a temperature at a middle position of the steel plate in the thickness direction reaches 550° C. to 700° C., whereby the difference in temperature between the surface of the steel plate and the middle position of the steel plate in the thickness direction when the reheating is completed is 20° C. or higher. The technique described in JP '962 seems to provide a steel plate in which the fraction of a second phase in the metal microstructure is 3% or less and in which the difference in hardness between a surface layer and the middle position of the steel plate in the thickness direction is 40 points or less in terms of Vickers hardness, the thick steel plate having excellent hydrogen induced cracking resistance. However, in the technique described in JP '962, disadvantageously, the reheating step is needed, making the production process complex. Furthermore, it is necessary to install a reheating apparatus and so forth.

Japanese Unexamined Patent Application Publication No. 2001-240936 discloses a method for producing a thick high-strength steel plate having a coarse-grained ferrite layer on each of the upper and lower surfaces, the method including performing rolling at a cumulative rolling reduction of 2% or more and a temperature of $Ac_1$−50° C. or lower in a cooling step after hot rolling a cast slab containing, on a mass percent, 0.01%-0.3% C, 0.6% or less Si, 0.2%-2.0% Mn, 0.06% or less Al, 0.005%-0.035% Ti, and 0.001%-0.006% N; heating the steel sheet to a temperature exceeding $Ac_1$ and less than $Ac_3$; and allowing the steel sheet to cool. The technique described in JP '936 seems to contribute to improvement in the SCC sensitivity, weather resistance, and corrosion resistance of a steel material, and to the suppression of the degradation of the material after cold forming. However, in the technique described in JP '936, disadvantageously, the reheating step is needed, making the production process complex. Furthermore, it is necessary to install a reheating apparatus and so forth.

In recent years, steel pipes to be used in a very cold land have often been required to have excellent fracture toughness, in particular, crack tip opening displacement characteristics (CTOD characteristics) and drop weight tear test characteristics (DWTT characteristics), from the viewpoint of preventing the burst of a pipeline.

For such a request, for example, Japanese Unexamined Patent Application Publication No. 2001-207220 discloses a method for producing a hot rolled steel sheet for a high-strength electric resistance welded steel pipe, the method including heating a steel slab containing, on a mass percent, C, Si, Mn, and N in an appropriate amount, Si and Mn in such a manner that Mn/Si satisfies 5 to 8, and 0.01%-0.1% Nb; performing rough rolling under conditions in which the reduction rate of first rolling at 1100° C. or higher is 15% to 30%, the total reduction rate at 1000° C. or higher is 60% or more, and the reduction rate of final rolling is 15% to 30%; cooling the steel sheet at a cooling rate of 5° C./s or more in such a manner that the temperature of a surface layer portion reaches the $Ar_1$ point or lower; initiating finish rolling when the temperature of the surface layer portion reaches ($Ac_3$−40° C.) to ($Ac_3$+40° C.) by recuperation or forced heating; terminating the finish rolling under conditions in which the total reduction rate is 60% or more at 950° C. or lower and in which the rolling end temperature is the $Ar_a$ point or higher; initiating cooling after 2 seconds of the termination of the finish rolling to cool the steel sheet to 600° C. or lower at a rate of 10° C./s or more; and coiling the steel sheet at 600° C. to 350° C. A steel sheet produced by the technique described in JP '220 seems to be formed into a high-strength electric resistance welded steel pipe having a fine microstructure of a surface layer of the steel sheet and excellent low-temperature toughness, in particular, excellent DWTT characteristics, without adding an expensive alloy element or performing heat treatment of the entire steel pipe. However, in the technique described in JP '220, in the case of a steel sheet having a large thickness, a desired cooling time is not ensured. To ensure desired properties, further improvement in cooling capacity is disadvantageously needed.

Japanese Unexamined Patent Application Publication No. 2004-315957 discloses method for producing a hot rolled steel strip for high-strength electric resistance welded steel pipe having excellent low-temperature toughness and excellent weldability, the method including heating a steel slab containing, on a mass percent, C, Si, Mn, Al, and N in appropriate amounts, 0.001%-0.1% Nb, 0.001%-0.1% V, and 0.001%-0.1% Ti, and one or two or more of Cu, Ni, and Mo, the steel slab having a Pcm value of 0.17 or less; terminating finish rolling under conditions in which the surface temperature is ($Ar_3$−50° C.) or higher; thereafter rapidly cooling the steel sheet; coiling the steel sheet at 700° C. or lower; and performing slow cooling.

However, in recent years, a steel sheet for a high-strength electric resistance welded steel pipe has been required to have further improved low-temperature toughness, in particular, the CTOD characteristics and the DWTT characteristics. In the technique described in JP '957, the low-temperature toughness is not sufficient. That is, unfortunately, the resulting steel sheet does not have excellent low-temperature toughness enough to satisfy CTOD characteristics and DWTT characteristics required.

Disadvantageously, a hot rolled steel sheet in the related art varies widely in material properties at points in the longitudinal direction and width direction of the sheet, in many cases.

It could therefore be helpful to provide a thick-walled high-strength hot rolled steel sheet for high strength electric resistance welded steel pipe or a high strength spiral steel pipe, the steel sheet having a high tensile strength TS of 510 MPa or more and excellent low-temperature toughness, in particular, excellent CTOD characteristics and DWTT characteristics, and to a method for producing the steel sheet without the need for the addition of large amounts of alloy elements.

It could also be helpful to further improve the uniformity of a material in the longitudinal direction and the width direction of the sheet.

It could further be helpful to provide a thick-walled high-strength hot rolled steel sheet having excellent uniformity of the material and an appropriate surface microstructure without a local increase in strength or the deterioration in ductility or toughness.

It could still further be helpful to provide a thick-walled high-strength hot rolled steel sheet having an appropriate surface microstructure and excellent uniformity of the microstructure in the thickness direction.

The term "excellent CTOD characteristics" used here indicates that a critical opening displacement (CTOD value) is 0.30 mm or more when a CTOD test is performed at a test temperature of −10° C. in conformity with the regulation of ASTM E 1290. The term "excellent DWTT characteristics" used here indicates that in the case where a DWTT test is performed in conformity with the regulation of ASTM E 436, the lowest temperature (DWTT temperature) when the percent shear fracture is 85% is −35° C. or lower.

SUMMARY

We thus provide:

[1] A thick-walled high-strength hot rolled steel sheet having excellent low-temperature toughness contains, on a mass percent basis, 0.02%-0.08% C, 0.01%-0.50% Si, 0.5%-1.8% Mn, 0.025% or less P, 0.005% or less S, 0.005%-0.10% Al, 0.01%-0.10% Nb, 0.001%-0.05% Ti, the balance being Fe, and incidental impurities, and a microstructure, in which C, Ti, and Nb are contained to satisfy expression (1):

$$(Ti+(Nb/2))/C<4 \quad (1)$$

(where Ti, Nb, and C each represent the proportion thereof (percent by mass)), and in which in the microstructure, the difference ΔD between the average grain size (μm) of a ferrite phase serving as a main phase at a position 1 mm from a surface of the steel sheet in the thickness direction and the average grain size (μm) of the ferrite phase serving as the main phase at a middle position of the steel sheet in the thickness direction is 2 μm or less, and the difference ΔV between the fraction (percent by volume) of a second phase at the position 1 mm from the surface of the steel sheet in the thickness direction and the fraction (percent by volume) of the second phase at the middle position of the steel sheet in the thickness direction is 2% or less.

[2] A thick-walled high-strength hot rolled steel sheet having excellent low-temperature toughness contains, on a mass percent basis, 0.02%-0.08% C, 0.01%-0.50% Si, 0.5%-1.8% Mn, 0.025% or less P, 0.005% or less S, 0.005%-0.10% Al, 0.01%-0.10% Nb, 0.001%-0.05% Ti, the balance being Fe, and incidental impurities, and a microstructure, in which C, Ti, and Nb are contained to satisfy expression (1):

$$(Ti+(Nb/2))/C<4 \quad (1)$$

(where Ti, Nb, and C each represent the proportion thereof (percent by mass)), and in which in the microstructure, the difference ΔD between the average grain size of a ferrite phase serving as a main phase at a position 1 mm from a surface of the steel sheet in the thickness direction and the average grain size of the ferrite phase serving as the main phase at a middle position of the steel sheet in the thickness direction is 2 μm or less, and the difference ΔV between the fraction (percent by volume) of a second phase at the position 1 mm from the surface of the steel sheet in the thickness direction and the fraction (percent by volume) of the second phase at the middle position of the steel sheet in the thickness direction is 2% or less, and in which mill scale having a thickness of 3 to 30 μm is formed on the surface of the steel sheet.

[3] A thick-walled high-strength hot rolled steel sheet having excellent low-temperature toughness contains, on a mass percent basis, 0.02%-0.08% C, 0.01%-0.50% Si, 0.5%-1.8% Mn, 0.025% or less P, 0.005% or less S, 0.005%-0.10% Al, 0.01%-0.10% Nb, 0.001%-0.05% Ti, the balance being Fe, and incidental impurities, and a microstructure, in which C, Ti, and Nb are contained to satisfy expression (1):

$$(Ti+(Nb/2))/C<4 \quad (1)$$

(where Ti, Nb, and C each represent the proportion thereof (percent by mass)), and in which in the microstructure, the difference ΔD between the average grain size of a ferrite phase serving as a main phase at a position 1 mm from a surface of the steel sheet in the thickness direction and the average grain size of the ferrite phase serving as the main phase at a middle position of the steel sheet in the thickness direction is 2 μm or less, and the difference ΔV between the fraction (percent by volume) of a second phase at the position 1 mm from the surface of the steel sheet in the thickness direction and the fraction (percent by volume) of the second phase at the middle position of the steel sheet in the thickness direction is 2% or less, and in which the difference ΔHV between Vickers hardness $HV_{1mm}$ at the position 1 mm from the surface of the steel sheet in the thickness direction and Vickers hardness $HV_{1/2t}$ at the middle position of the steel sheet in the thickness direction is 50 points or less.

[4] A thick-walled high-strength hot rolled steel sheet having excellent low-temperature toughness contains, on a mass percent basis, 0.02%-0.08% C, 0.01%-0.50% Si, 0.5%-1.8% Mn, 0.025% or less P, 0.005% or less S, 0.005%-0.10% Al, 0.01%-0.10% Nb, 0.001%-0.05% Ti, the balance being Fe, and incidental impurities, and a microstructure, in which C, Ti, and Nb are contained to satisfy expression (1):

$$(Ti+(Nb/2))/C<4 \quad (1)$$

(where Ti, Nb, and C each represent the proportion thereof (percent by mass)), and in which in the microstructure, the difference ΔD between the average grain size of a ferrite phase serving as a main phase at a position 1 mm from a surface of the steel sheet in the thickness direction and the average grain size of the ferrite phase serving as the main phase at a middle position of the steel sheet in the thickness direction is 2 μm or less, and the difference ΔV between the fraction (percent by volume) of a second phase at the position 1 mm from the surface of the steel sheet in the thickness direction and the fraction (percent by volume) of the second phase at the middle position of the steel sheet in the thickness direction is 2% or less, and in which the minimum lath spacing of a bainite phase or a tempered martensitic phase at the position 1 mm from the surface of the steel sheet in the thickness direction is 0.1 μm or more.

[5] The thick-walled high-strength hot rolled steel sheet described in any one of items [1] to [4] further contains, on a mass percent basis, one or two or more selected from 0.01%-0.10% V, 0.01%-0.50% Mo, 0.01%-1.0% Cr, 0.01%-0.50% Cu, and 0.01%-0.50% Ni.

[6] The thick-walled high-strength hot rolled steel sheet described in any one of items [1] to [5] further contains, on a mass percent basis, 0.0005%-0.005% Ca.

[7] A method of producing a thick-walled high-strength hot rolled steel sheet having excellent low-temperature toughness includes heating a steel material containing, on a mass percent basis, 0.02%-0.08% C, 0.01%-0.50% Si, 0.5%-1.8% Mn, 0.025% or less P, 0.005% or less S, 0.005%-0.10% Al, 0.01%-0.10% Nb, 0.001%-0.05% Ti, the balance being Fe, and incidental impurities, C, Ti, and Nb being contained to satisfy expression (1):

$$(Ti+(Nb/2))/C<4 \quad (1)$$

(where Ti, Nb, C each represent the proportion thereof (percent by mass));

performing hot rolling including rough rolling and finish rolling to form a hot rolled steel sheet; after the completion of the hot rolling, performing accelerated cooling at an average cooling rate of 10° C./s or more at a middle position of a steel sheet in the thickness direction to a cooling stop temperature of BFS or lower at the middle position of the steel sheet in the thickness direction, the BFS being defined by expression (2):

$$BFS\ (°\ C.)=770-300C-70Mn-70Cr-170Mo-40Cu-40Ni-1.5CR \quad (2),$$

(where C, Mn, Cr, Mo, Cu, and Ni each represent the proportion thereof (percent by mass), and CR represents the average cooling rate (° C./s) at the middle position of the steel sheet in the thickness direction); and performing coiling at a coiling temperature of BFS0 or lower at the middle position of the steel sheet in the thickness direction, the BFS0 being defined by expression (3):

$$BFS0\ (°\ C.)=770-300C-70Mn-70Cr-170Mo-40Cu-40Ni \quad (3)$$

(where C, Ti, Nb, Mn, Cr, Mo, Cu, and Ni each represent the proportion thereof (percent by mass)).

[8] A method of producing a thick-walled high-strength hot rolled steel sheet having excellent low-temperature toughness includes heating a steel material containing, on a mass percent basis, 0.02%-0.08% C, 0.01%-0.50% Si, 0.5%-1.8% Mn, 0.025% or less P, 0.005% or less S, 0.005%-0.10% Al, 0.01%-0.10% Nb, 0.001%-0.05% Ti, the balance being Fe, and incidental impurities, C, Ti, and Nb being contained to satisfy expression (1):

$$(Ti+(Nb/2))/C<4 \quad (1)$$

(where Ti, Nb, C each represent the proportion thereof (percent by mass));

performing hot rolling including rough rolling and finish rolling to form a hot rolled steel sheet; performing scale removal treatment with a scale breaker before the rough rolling and before the finish rolling, in which in the hot rolling, the finish entry temperature (FET) is set in the range of 800° C. to 1050° C., and finish delivery temperature (FDT) is set in the range of 750° C. to 950° C.; after the completion of the hot rolling, performing accelerated cooling at an average cooling rate of 10° C./s or more at a middle position of a steel sheet in the thickness direction to a cooling stop temperature of BFS or lower at the middle position of the steel sheet in the thickness direction, the BFS being defined by expression (2):

$$BFS\ (°\ C.)=770-300C-70Mn-70Cr-170Mo-40Cu-40Ni-1.5CR \quad (2),$$

(where C, Mn, Cr, Mo, Cu, and Ni each represent the proportion thereof (percent by mass), and CR represents the average cooling rate (° C./s) at the middle position of the steel sheet in the thickness direction); and performing coiling at a coiling temperature of BFS0 or lower at the middle position of the steel sheet in the thickness direction, the BFS0 being defined by expression (3):

$$BFS0\ (°\ C.)=770-300C-70Mn-70Cr-170Mo-40Cu-40Ni \quad (3)$$

(where C, Ti, Nb, Mn, Cr, Mo, Cu, and Ni each represent the proportion thereof (percent by mass)).

[9] A method of producing a thick-walled high-strength hot rolled steel sheet having excellent low-temperature toughness includes heating a steel material containing, on a mass percent basis, 0.02%-0.08% C, 0.01%-0.50% Si, 0.5%-1.8% Mn, 0.025% or less P, 0.005% or less S, 0.005%-0.10% Al, 0.01%-0.10% Nb, 0.001%-0.05% Ti, the balance being Fe, and incidental impurities, C, Ti, and Nb being contained to satisfy expression (1):

$$(Ti+(Nb/2))/C<4 \quad (1)$$

(where Ti, Nb, C each represent the proportion thereof (percent by mass));

performing hot rolling including rough rolling and finish rolling to form a hot rolled steel sheet; after the completion of the hot rolling, performing accelerated cooling at an average cooling rate of 10° C./s or more at a middle position of a steel sheet in the thickness direction to a cooling stop temperature of BFS or lower at the middle position of the steel sheet in the thickness direction, in which in the accelerated cooling, when the carbon equivalent Ceq is 0.37% or less, the average cooling rate at a position 1 mm from a surface of the steel sheet in the thickness direction is set to 10° C./s or more, and when the carbon equivalent Ceq exceeds 0.37%, the average cooling rate is set to 10 to 200° C./s, the carbon equivalent Ceq being defined by expression (4):

$$Ceq\ (\%)=C+Mn/6+(Cr+Mo+V)/5+(Ni+Cu)/15 \quad (4)$$

(where C, Ti, Mn, Cr, Mo, V, Cu, and Ni each represent the proportion thereof (percent by mass)), and the BFS being defined by expression (2):

$$BFS\ (°\ C.)=770-300C-70Mn-70Cr-170Mo-40Cu-40Ni-1.5CR \quad (2),$$

(where C, Mn, Cr, Mo, Cu, and Ni each represent the proportion thereof (percent by mass), and CR represents the average cooling rate (° C./s) at the middle position of the steel sheet in the thickness direction); and performing coiling at a coiling temperature of BFS0 or lower at the middle position of the steel sheet in the thickness direction, the BFS0 being defined by expression (3):

$$BFS0\ (°\ C.)=770-300C-70Mn-70Cr-170Mo-40Cu-40Ni \quad (3)$$

(where C, Ti, Nb, Mn, Cr, Mo, Cu, and Ni each represent the proportion thereof (percent by mass)).

[10] A method of producing a thick-walled high-strength hot rolled steel sheet having excellent low-temperature toughness includes heating a steel material containing, on a mass percent basis, 0.02%-0.08% C, 0.01%-0.50% Si, 0.5%-1.8% Mn, 0.025% or less P, 0.005% or less S, 0.005%-0.10% Al, 0.01%-0.10% Nb, 0.001%-0.05% Ti, the balance being Fe, and incidental impurities, C, Ti, and Nb being contained to satisfy expression (1):

$$(Ti+(Nb/2))/C<4 \quad (1)$$

(where Ti, Nb, C each represent the proportion thereof (percent by mass));

performing hot rolling including rough rolling and finish rolling to form a hot rolled steel sheet; after the completion of the hot rolling, performing accelerated cooling at an average cooling rate of 10° C./s or more at a middle position of a steel sheet in the thickness direction to a cooling stop temperature of BFS or lower at the middle position of the steel sheet in the thickness direction, in which the accelerated cooling is performed at an average cooling rate of 100° C./s or more at a position 1 mm from a surface of the steel sheet in the thickness direction, the BFS being defined by expression (2):

$$BFS\ (°\ C.)=770-300C-70Mn-70Cr-170Mo-40Cu-40Ni-1.5CR \quad (2),$$

(where C, Mn, Cr, Mo, Cu, and Ni each represent the proportion thereof (percent by mass), and CR represents the average cooling rate (° C./s) at the middle position of the steel sheet in the thickness direction); and performing coiling at a coiling temperature of BFS0 or lower at the middle position of the steel sheet in the thickness direction, in which the coiling is performed at a coiling temperature of 300° C. or higher at a middle position of the steel sheet in the thickness direction, the BFS0 being defined by expression (3):

$$BFS0\ (°\ C.)=770-300C-70Mn-70Cr-170Mo-40Cu-40Ni \quad (3)$$

(where C, Ti, Nb, Mn, Cr, Mo, Cu, and Ni each represent the proportion thereof (percent by mass)).

[11] The method of producing a thick-walled high-strength hot rolled steel sheet described in any one of items 7 to 10 further contains, on a mass percent basis, one or two or more selected from 0.01%-0.10% V, 0.01%-0.50% Mo, 0.01%-1.0% Cr, 0.01%-0.50% Cu, and 0.01%-0.50% Ni.

[12] The method of producing a thick-walled high-strength hot rolled steel sheet described in any one of items 7 to 11 further contains, on a mass percent basis, 0.0005%-0.005% Ca.

The term "ferrite serving as a main phase" indicates that a microstructure serving as a main phase is hard low-temperature transformation ferrite, i.e., indicates bainitic ferrite or bainite, excluding soft high-temperature transformation ferrite (granular polygonal ferrite). Hereinafter, the term "ferrite serving as a main phase" indicates hard low-temperature transformation ferrite (bainitic ferrite, bainite, or a mixed phase thereof), unless otherwise specified. The second phase indicates perlite, martensite, a martensite-austenite constituent (MA) (also referred to as island martensite), or a mixed phase thereof.

The temperature used in the finish rolling is indicated by a temperature of the surface. Values of the temperature at the middle position of the steel sheet in the thickness direction in the accelerated cooling, the cooling rate, and the coiling temperature are determined using heat transfer calculation or the like from surface temperatures measured.

It is possible to easily produce a thick-walled high-strength hot rolled steel sheet at low cost, the steel sheet having excellent low-temperature toughness, in particular, excellent DWTT characteristics and excellent CTOD characteristics, and good uniformity of the microstructure in the thickness direction, which is industrially extremely advantageous. Furthermore, it is possible to easily produce an electric resistance welded steel pipe and a spiral steel pipe for a transport pipe having excellent low-temperature toughness and excellent girth weldability in pipeline construction.

In addition to the foregoing advantages, the steel sheet has only small nonuniformity of the material in the longitudinal direction and the width direction of the sheet, i.e., the steel sheet has excellent uniformity of the material.

In addition to the foregoing advantages, the steel sheet has excellent dimensional accuracy.

In addition to the foregoing advantages, the steel sheet has excellent pipe formability and excellent dimensional accuracy.

DETAILED DESCRIPTION

Figure 1:
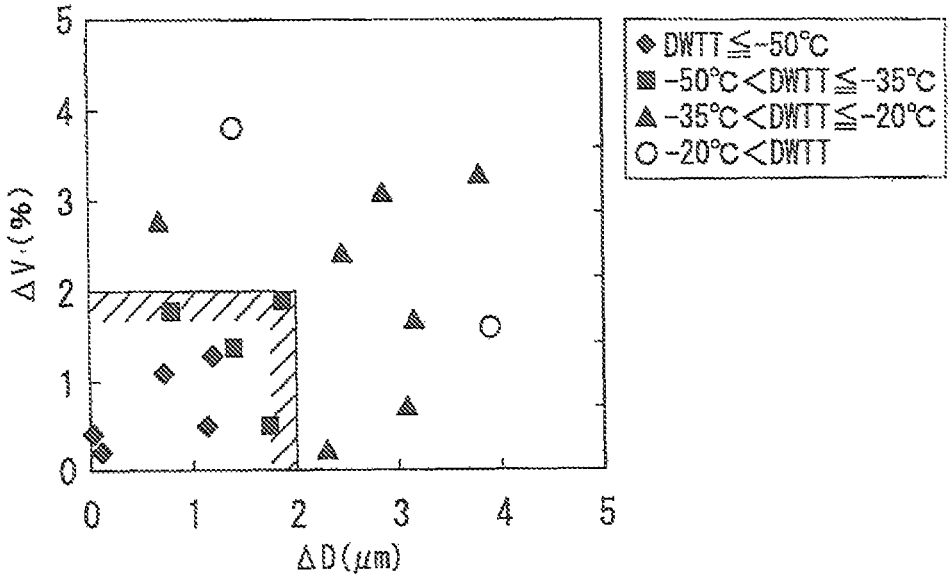
FIG. 1 is a graph illustrating the relationship between ΔD and ΔV that affect DWTT.

We conducted intensive studies of various factors affecting low-temperature toughness, in particular, DWTT characteristics and CTOD characteristics, and discovered that the DWTT characteristics and the CTOD characteristics, which are determined by toughness tests at the entire thickness, are significantly affected by the uniformity of the microstructure in the thickness direction. We found that the effect of the nonuniformity of the microstructure in the thickness direction on the DWTT characteristics and the CTOD characteristics is manifested in the case of a thick-walled steel sheet having a thickness of 11 mm or more.

We conducted further studies and found that "excellent DWTT characteristics" and "excellent CTOD characteristics" are ensured when the difference ΔD between the average grain size of ferrite serving as a main phase at a position (surface layer portion) 1 mm from a surface of a steel sheet in the thickness direction and the average grain size of ferrite serving as the main phase at a middle position (middle portion in the thickness direction) of the steel sheet in the thickness direction is 2 μm or less and when the difference ΔV between the fraction (volume fraction) of a second phase at the position (surface layer portion) 1 mm from the surface of the steel sheet in the thickness direction and the fraction (volume fraction) of the second phase at the middle position (middle portion in the thickness direction) of the steel sheet in the thickness direction is 2% or less.

Experimental results will be described below.

Experimental Example 1

A slab containing, on a mass percent basis, 0.037% C, 0.20% Si, 1.59% Mn, 0.016% P, 0.0023% S, 0.041% Al, 0.061% Nb, 0.013% Ti, and balance Fe was used as a steel material, provided that (Ti+Nb/2)/C was 1.18.

The steel material having the foregoing composition was heated to 1230° C. and subjected to hot rolling at a finish rolling start temperature of 980° C. and a finish rolling end temperature of 800° C. to form hot rolled steel sheets having a thickness of 14.5 mm. After the completion of the hot rolling, the hot rolled steel sheets were subjected to accelerated cooling to various cooling stop temperatures at a cooling rate of 18° C./s in a temperature region in which a temperature at each middle position in the thickness direction exceeded 750° C., followed by coiling at various coiling temperatures (temperature at each middle position in the thickness direction) to form hot rolled steel sheets (steel strips).

Test specimens were taken from the resulting hot rolled steel sheet. The microstructures and the DWTT characteristics were investigated. With respect to the microstructures, the average grain size (μm) of ferrite serving as a main phase and the fraction (percent by volume) of a second phase were determined at a position (surface layer portion) 1 mm from a surface of each steel sheet in the thickness direction and the middle position (middle portion in the thickness direction) of each steel sheet in the thickness direction. The difference ΔD between the average grain size of ferrite serving as the main phase at the position (surface layer portion) 1 mm from the surface of each steel sheet and the average grain size of ferrite serving as the main phase at the middle position (middle portion in the thickness direction) of the steel sheet in the thickness direction were calculated from the resulting measurement values. The difference ΔV between the fraction of the second phase at the position (surface layer portion) 1 mm from the surface of each steel sheet and the fraction of the second phase at the middle position (middle portion in the thickness direction) of the steel sheet in the thickness direction were calculated from the resulting measurement values. Note that the second phase is composed of, for example, pearlite, martensite, or a martensite-austenite constituent (MA) (also referred to as "island martensite").

The results are illustrated in FIG. 1 using the relationship between ΔD and ΔV that affect DWTT.

Note that the microstructures and the DWTT characteristics were investigated as in (1) Microstructure Observation and (4) DWTT Test in Example 1 described below.

Figure 2:
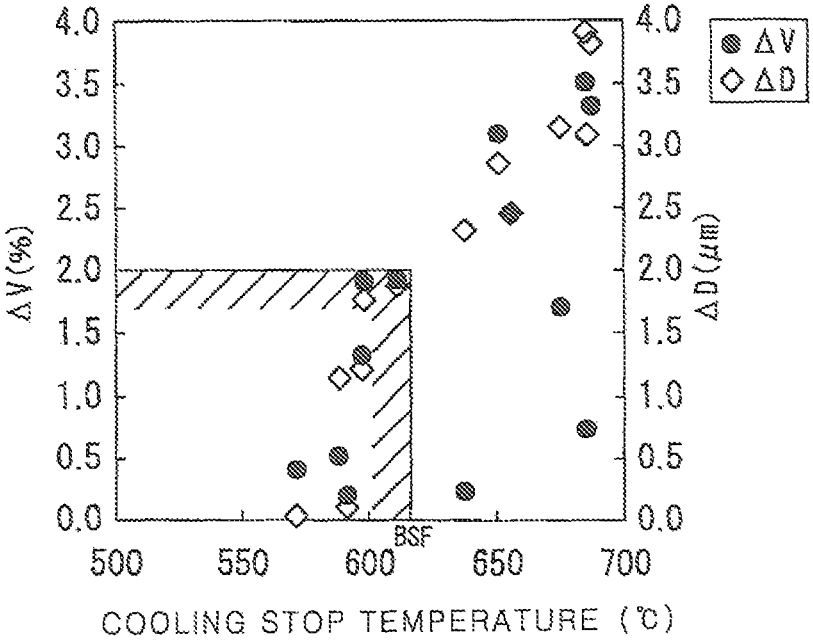
FIG. 2 is a graph illustrating the relationship among ΔD, ΔV, and the cooling stop temperature of accelerated cooling.
Figure 3:
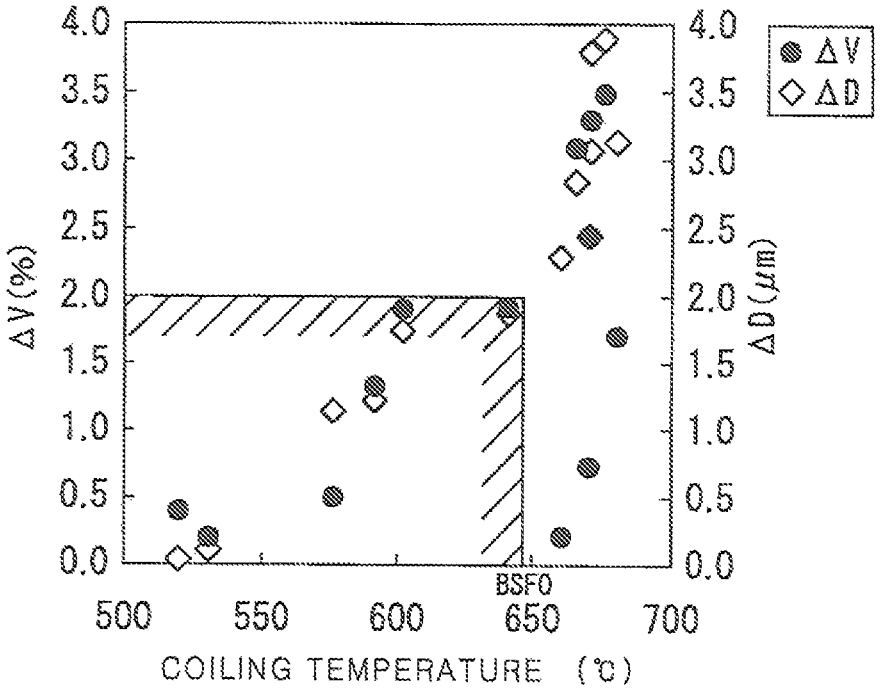
FIG. 3 is a graph illustrating the relationship among ΔD, ΔV, and the coiling temperature.

FIG. 1 demonstrates that the "excellent DWTT characteristics," in which the DWTT is −35° C. or lower, are reliably maintained at a ΔD of 2 μm or less and a ΔV of 2% or less. FIG. 2 illustrates the relationship among ΔD, ΔV, and the cooling stop temperature. FIG. 3 illustrates the relationship among ΔD, ΔV, and the coiling temperature.

FIGS. 2 and 3 demonstrate that to achieve a ΔD of 2 μm or less and a ΔV of 2% or less, the cooling stop temperature and the coiling temperature for the steel used need to be adjusted to 620° C. or lower and 647° C. or lower, respectively.

We conducted further studies and found that the cooling stop temperature and the coiling temperature required to achieve a ΔD of 2 μm or less and a ΔV of 2% or less are determined, mainly depending on the alloy element content and the cooling rate after the completion of the hot rolling, which affect the bainitic transformation start temperature. That is, to achieve a ΔD of 2 μm or less and a ΔV of 2% or less, it is important that the cooling stop temperature at the middle position of the steel sheet in the thickness direction is set to BFS or lower, BFS being defined by the expression:

$$BFS\ (^\circ\ C.)=770-300C-70Mn-70Cr-170Mo-40Cu-40Ni-1.5CR$$

(wherein C, Mn, Cr, Mo, Cu, and Ni each represent the proportion thereof (percent by mass), and CR represents the average cooling rate (° C./s) at the middle position of the steel sheet in the thickness direction), and the coiling temperature at the middle position of the steel sheet in the thickness direction is set to BFS0 or lower, BFS0 being defined by the expression:

$$BFS0\ (^\circ\ C.)=770-300C-70Mn-70Cr-170Mo-40Cu-40Ni$$

(wherein C, Mn, Cr, Mo, Cu, and Ni each represent the proportion thereof (percent by mass)).

We conducted further studies and found that, to improve the uniformity of the material of the steel sheet in the longitudinal direction and the width direction, it is necessary to adjust the thickness of mill scale formed on a surface of the hot rolled steel sheet in an appropriate range.

Experimental results that form the basis of this finding will be described below.

Experimental Example 2

A slab containing, on a mass percent basis, 0.053% C, 0.20% Si, 1.60% Mn, 0.012% P, 0.0026% S, 0.035% Al, 0.061% Nb, 0.013% Ti, 0.0032% N, and balance Fe was used as a steel material, provided that (Ti+Nb/2)/C was 0.82.

The steel material having the composition described above was heated to 1200° C. and subjected to hot rolling including rough rolling and finish rolling to form hot rolled steel sheets (steel strips). Note that scale removal treatment was performed with a rough scale breaker (RSB) before the rough rolling. In the finish rolling, scale removal treatment was performed with a finish scale breaker (FSB) before the finish rolling, and hot rolling was performed at various finish entry temperatures (FETs) and finish delivery temperatures (FDTs), thereby forming 15.6-mm-thick hot rolled steel sheets with different thicknesses of mill scale. After the completion of the hot rolling, the hot rolled steel sheets were subjected to accelerated cooling to a cooling stop temperature of 540° C. at a cooling rate of 50° C./s in a temperature region in which a temperature at the middle position of each steel sheet in the thickness direction was 750° C. or lower, followed by coiling at a coiling temperature of 520° C.

A tensile specimen (thickness: 1 mm, width: 12.5 mm, GL=25 mm) was taken at a position 1 mm from a surface of each of the resulting hot rolled steel sheets in the thickness direction. The tensile properties were investigated.

Figure 4A:
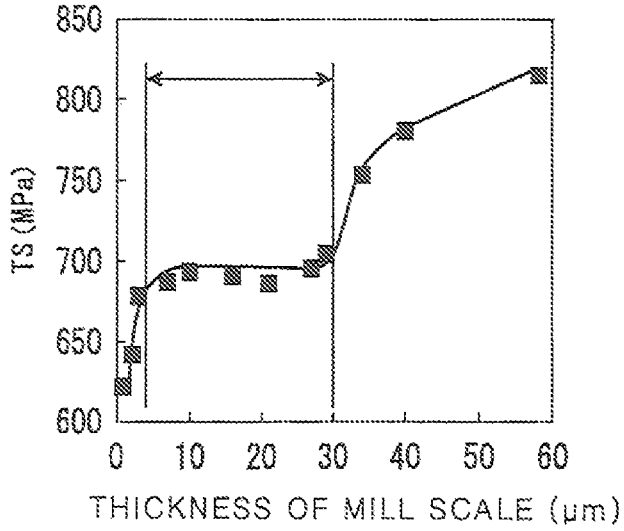
FIG. 4A is a graph illustrating the effect of the mill scale on the tensile strength of a surface layer.
Figure 4B:
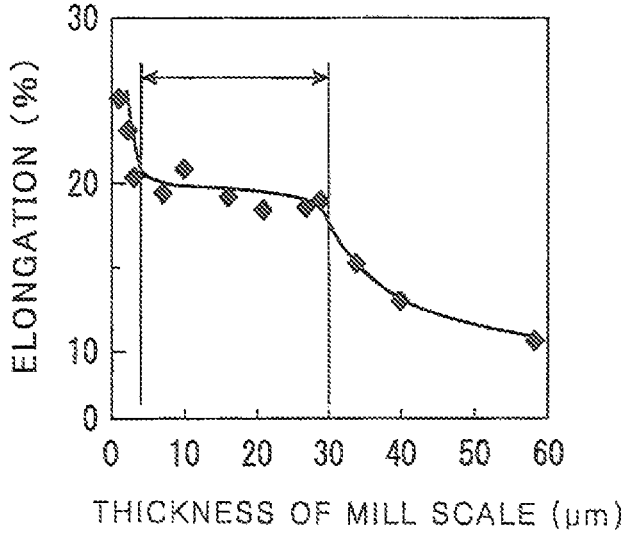
FIG. 4B is a graph illustrating the effect of the mill scale on the elongation of a surface layer.

FIGS. 4A and 4B illustrate the relationship between the tensile properties (tensile strength TS and elongation El) and the thickness (μm) of mill scale on the basis of the results. Note that the tensile properties and the thickness of mill scale were measured as in (2) Tensile Test and the measurement of the thickness of mill scale in (1) Microstructure Observation in Example 2 described below.

FIGS. 4A and 4B show that a thickness of the mill scale of 5 to 30 μm results in only small changes in the tensile properties (TS and El) of the surface layer. From the results, we discovered that the adjustment of the thickness of the mill scale in an appropriate range reduces variations in the tensile properties of the surface layer and the nonuniformity of the material of the steel sheet in the longitudinal direction and the width direction, thereby further improving the uniformity of the material.

Further studies demonstrated that, even if the foregoing accelerated cooling is performed after the completion of the hot rolling, the strength can be locally increased to deteriorate pipe formability, and that this is because the hardness at the position 1 mm from the surface of the steel sheet can be locally increased. We discovered that the difference ΔHV between Vickers hardness $HV_{1mm}$ at the position 1 mm from the surface of the steel sheet in the thickness direction and Vickers hardness $HV_{1/2t}$ at the middle position of the steel sheet in the thickness direction is required to be 50 points or less to suppress deterioration in pipe formability. It is important that the Vickers hardness $HV_{1mm}$ at the position 1 mm from the surface of the steel sheet in the thickness direction is not extremely high to achieve a ΔHV of 50 points or less. In particular, higher proportions of alloy elements improve hardenability. For example, the Vickers hardness $HV_{1mm}$ at the position 1 mm from the surface of the steel sheet in the thickness direction is largely increased. Hence, this is more likely to cause ΔHV to be increased to a value exceeding 50 points. We discovered that, in the case where the carbon equivalent Ceq of the hot rolled steel sheet exceeds a specific value, the cooling rate at the position 1 mm from the surface of the steel sheet in the thickness direction in the accelerated cooling subsequent to the completion of the hot rolling is required to be adjusted in response to the carbon equivalent Ceq in such a manner that the cooling rate at the position 1 mm from the surface of the steel sheet in the thickness direction is a specific cooling rate or less.

Experimental results that form the basis of this finding will be described below.

Experimental Example 3

A slab containing, on a mass percent basis, 0.04% to 0.06% C, 0.2% to 0.7% Si, 0.93% to 1.84% Mn, 0.030% to 0.048% Al, 0.045% to 0.15% Nb, 0.009% to 0.03% Ti, 0% to 0.25% Ni, 0% to 0.25% Cu, 0% to 0.059% V, balance Fe and incidental impurities was used as a steel material, the carbon equivalent Ceq being 0.234 to 0.496. The carbon equivalent Ceq was calculated using the expression:

$$Ceq\ (\%)=C+Mn/6+(Cr+Mo+V)/5+(Ni+Cu)/15 \quad (4)$$

(wherein C, Mn, Cr, Mo, V, Cu, and Ni each represent the proportion thereof (percent by mass)).

The steel material having the foregoing composition was heated to 1200° C. and subjected to hot rolling at a finish rolling start temperature of 1010° C. and a finish rolling end temperature of 810° C. to form hot rolled steel sheets having a thickness of 25.4 mm. After the completion of the hot rolling, the hot rolled steel sheets were subjected to accelerated cooling to a cooling stop temperature of 470° C. to 490° C. at the middle position of each steel sheet in the thickness direction at a cooling rate of 18 to 27° C./s at the middle position of each steel sheet in the thickness direction and an average cooling rate of 80° C./s or 200° C./s at the position 1 mm from the surface of each steel sheet in the thickness direction, followed by coiling at a coiling temperature of 460° C. to 500° C. at the middle position of each steel sheet in the thickness direction. Test specimens for the measurement of hardness were taken from the resulting hot rolled steel sheets. Vickers hardness $HV_{1mm}$ at the position 1 mm from the surface of each steel sheet in the thickness direction and Vickers hardness $HV_{1/2t}$ at the middle position of each steel sheet in the thickness direction were measured with a Vickers hardness tester (load: 10 kgf) in a cross section orthogonal to the direction of the hot rolling. The difference ΔHV ($=HV_{1mm}-HV_{1/2t}$) was then calculated.

Figure 5:
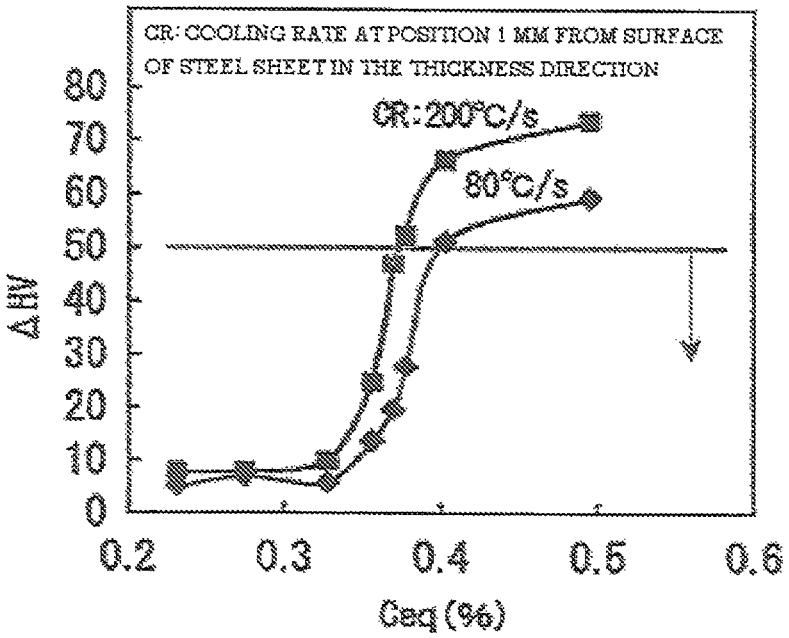
FIG. 5 is a graph illustrating the effect of the carbon equivalent Ceq on ΔHV.

FIG. 5 illustrates the relationship between ΔHV and the carbon equivalent Ceq on the basis of the results when the accelerated cooling operations were performed at average cooling rates of 80° C./s and 200° C./s at the positions 1 mm from the surfaces of the steel sheets in the thickness direction. Note that ΔHV was measured as in (2) Tensile Test in Example 3 described below.

Figure 6:
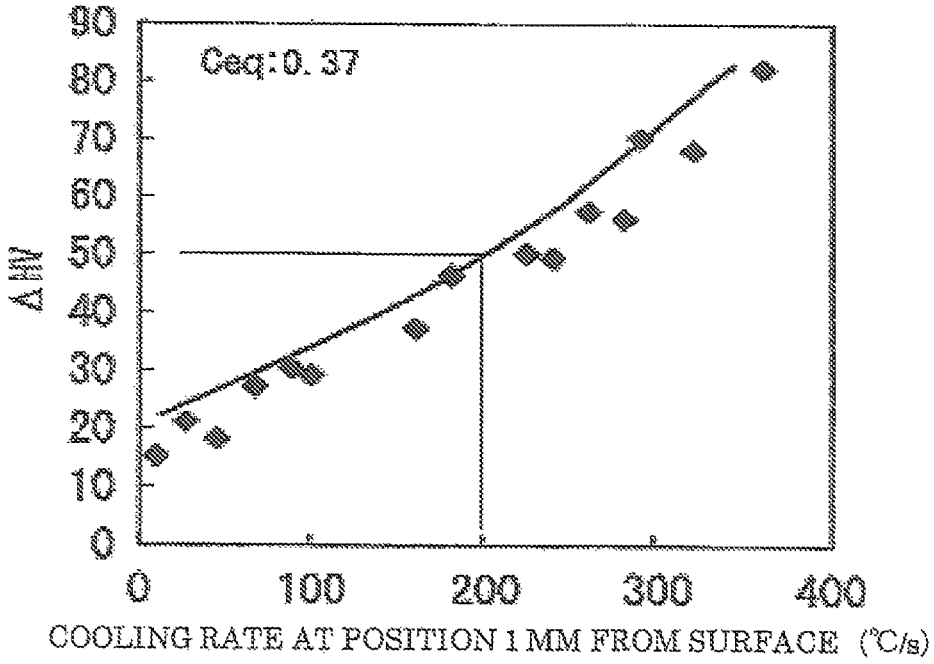
FIG. 6 is a graph illustrating the effect of the average cooling rate on ΔHV at a position 1 mm from a surface of a steel sheet in the thickness direction (at a carbon equivalent Ceq of 0.37%).

FIG. 5 shows that when ΔHV is 50 points, the Ceq values are 0.40% at an average cooling rate of 80° C./s and 0.37% at 200° C./s. To achieve a ΔHV of 50 points or less, the results demonstrate that if Ceq exceeds 0.37%, the average cooling rate at the position 1 mm from the surface of the steel sheet in the thickness direction needs to be 200° C./s or less. Furthermore, a steel material containing, on a mass percent basis, 0.043% C, 0.22% Si, 1.64% Mn, 0.015% P, 0.0027% S, 0.038% Al, 0.059% Nb, 0.011% Ti, 0.18% Cu, 0.18% Ni, 0.16% Mo, balance Fe and incidental impurities (Ceq=0.37%) was heated to 1210° C. and subjected to hot rolling at a finish rolling start temperature of 1210° C. and a finish rolling end temperature of 800° C. to form hot rolled steel sheets (thickness: 25.4 mm). After the completion of the hot rolling, the hot rolled steel sheets were subjected to cooling operations at average cooling rates of 10 to 350° C./s at the position 1 mm from the surface of each steel sheet in the thickness direction. Test specimens for the measurement of hardness were taken from the resulting hot rolled steel sheets. Vickers hardness $HV_{1mm}$ at the position 1 mm from the surface of each steel sheet in the thickness direction and Vickers hardness $HV_{1/2t}$ at the middle position of each steel sheet in the thickness direction were measured in a cross section orthogonal to the direction of the hot rolling. ΔHV ($=HV_{1mm}-HV_{1/2}$) was then calculated. FIG. 6 illustrates the relationship ΔHV and the average cooling rate at the position 1 mm from the surface of the steel sheet in the thickness direction on the basis of the results. FIG. 6 shows that the cooling rate at the position 1 mm from the surface of the steel sheet in the thickness direction needs to be 200° C./s or less to achieve a ΔHV of 50 points or less.

Further studies demonstrated that, even if the foregoing accelerated cooling is performed after the completion of the hot rolling, the strength can be locally increased to deteriorate pipe formability, and that this is because the hardness at the position 1 mm from the surface of the steel sheet can be locally increased. We found that this phenomenon occurs when the minimum lath spacing of a bainite phase, a bainitic ferrite phase, or a tempered martensitic phase is less than 0.1 μm at the position 1 mm from the surface of the steel sheet in the thickness direction. We conducted further studies and discovered that, to suppress a deterioration in pipe formability, cooling on a hot run table after the completion of the hot rolling is adjusted in such a manner that the coiling temperature is 300° C. or higher.

Experimental results that form the basis of this finding will be described below.

Experimental Example 4

A slab containing, on a mass percent basis, 0.04% to 0.06% C, 0.20% to 0.70% Si, 0.93% to 1.84% Mn, 0.030% to 0.048% Al, 0.045% to 0.15% Nb, 0.009% to 0.03% Ti, 0% to 0.25% Ni, 0% to 0.25% Cu, 0% to 0.06% V, balance Fe and incidental impurities was used as a steel material, the carbon equivalent Ceq being 0.234 to 0.496. The carbon equivalent Ceq was calculated using the expression:

$$Ceq\ (\%)=C+Mn/6+(Cr+Mo+V)/5+(Ni+Cu)/15 \quad (4)$$

(wherein C, Mn, Cr, Mo, V, Cu, and Ni each represent the proportion thereof (percent by mass)).

The steel material having the foregoing composition was heated to 1210° C. and subjected to hot rolling at a finish rolling start temperature of 1000° C. and a finish rolling end temperature of 800° C. to form hot rolled steel sheets having a thickness of 25.4 mm. After the completion of the hot rolling, the hot rolled steel sheets were subjected to accelerated cooling to a cooling stop temperature of 200° C. to 500° C. at the middle position of each steel sheet in the thickness direction at a cooling rate of 34° C./s at the middle position of each steel sheet in the thickness direction and an average cooling rate of 300° C./s at the position 1 mm from the surface of each steel sheet in the thickness direction, followed by coiling at two coiling temperatures of lower than 300° C. and 300° C. or higher at the middle positions of the steel sheets in the thickness direction. Test specimens (thin films) for microstructure observation were taken from the resulting hot rolled steel sheets. The lath spacing of bainite, bainitic ferrite, or tempered martensite at the position 1 mm from the surface of each steel sheet in the thickness direction was measured with a transmission electron microscope (magnification: 50,000×), thereby determining the minimum lath spacing of each hot rolled steel sheets.

Figure 7:
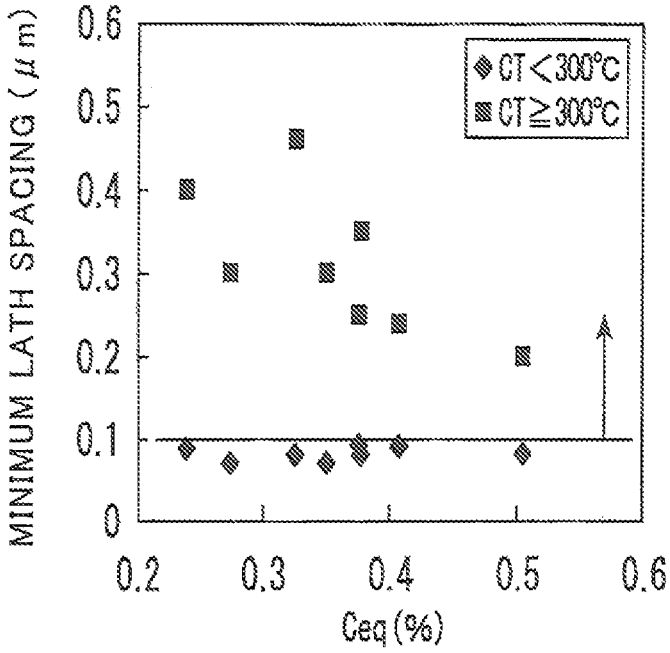
FIG. 7 is a graph illustrating the effect of the coiling temperature on the relationship between the minimum lath spacing and the carbon equivalent Ceq.

FIG. 7 illustrates the relationship between the minimum lath spacing and the carbon equivalent Ceq on the basis of the results.

Note that the minimum lath spacing was measured in the same way as the measurement of the minimum lath spacing in (1) Microstructure Observation in Example 4 described below.

FIG. 7 shows that a coiling temperature CT of 300° C. or higher allows the minimum lath spacing in the bainite phase, the bainitic ferrite phase, or the tempered martensitic phase at the position 1 mm from the surface of the steel sheet in the thickness direction to be 0.1 μm or more, regardless of the carbon equivalent Ceq.

That is, we found that, after the completion of the hot rolling, the resulting steel sheet is subjected to cooling on the hot run table to a cooling stop temperature of 300° C. to BFS at the middle position of the steel sheet in the thickness direction and then coiling at a coiling temperature of 300° C. or higher at the middle position of the steel sheet in the thickness direction to promote self-annealing, thereby achieving a minimum lath spacing of 0.1 μm or more in the bainite phase (including bainitic ferrite phase) or the tempered martensitic phase at the position 1 mm from the surface of the steel sheet in the thickness direction.

The reason for the limitation of the composition of the thick-walled high-strength hot rolled steel sheet will be described below. Note that "%" indicates "percent by mass" unless otherwise specified.

C: 0.02% to 0.08%

C is an element having the effect of increasing the strength of steel. For the purpose of ensuring desired high strength, the C content needs to be 0.02% or more. An excessively high C content exceeding 0.08% causes an increase in the fraction of a second phase, such as pearlite, thereby deteriorating the toughness of the base metal and the toughness of a welded heat affected zone. Thus, the C content is limited to 0.02% to 0.08%. The C content is preferably in the range of 0.04% to 0.06%.

Si: 0.01% to 0.50%

Si has the effect of enhancing solid-solution strengthening and improving hardenability to increase the strength of steel. The effect is observed at a Si content of 0.01% or more. Furthermore, Si has the effect of allowing the C content in a γ phase (austenite phase) to be increased during the γ (austenite) to a (ferrite) transformation to promote the formation of the martensitic phase serving as a second phase. This results in an increase in ΔD, deteriorating the toughness of the steel sheet. Moreover, Si forms a Si-containing oxide during electric resistance welding, thereby deteriorating the quality of a welded portion and the toughness of a welded heat affected zone. From such a viewpoint, while Si is preferably minimized, a Si content of 0.50% is acceptable. Thus, the Si content is limited to 0.01% to 0.50%. The Si content is preferably 0.40% or less.

In the case of a hot rolled steel sheet for electric resistance welded steel pipes, Mn is contained. Thus, Si forms low-melting-point manganese silicate. The oxide is easily ejected from a welded portion. Hence, the Si content may be 0.10% to 0.30%.

Mn: 0.5% to 1.8%

Mn has the effect of improving hardenability and thereby increasing the strength of a steel sheet. Furthermore, Mn forms MnS to fix S, thereby preventing the grain boundary segregation of S and suppressing the cracking of a slab (steel material). To provide the effect, the Mn content needs to be 0.5% or more.

A Mn content exceeding 1.8% results in the promotion of solidification segregation during slab casting, a high Mn content portion left in a steel sheet, and the increase of the occurrence of separation. To eliminate the high Mn content portion, heating to a temperature exceeding 1300° C. is needed. The implementation of such heat treatment in an industrial scale is impractical. Thus, the Mn content is limited to 0.5% to 1.8%. The Mn content is preferably in the range of 0.9% to 1.7%.

P: 0.025% or less

P is inevitably contained as an impurity in steel and has the effect of increasing the strength of steel. However, an excessively high P content exceeding 0.025% leads to a deterioration reduction in weldability. Thus, the P content is limited to 0.025% or less. The P content is preferably 0.015% or less.

S: 0.005% or less

As with P, S is inevitably contained as an impurity in steel. A S content exceeding 0.005% causes slab cracking and the formation of coarse MnS in a hot rolled steel sheet, thereby deteriorating the ductility. Thus, the S content is limited to 0.005% or less. The S content is preferably 0.004% or less.

Al: 0.005% to 0.10%

Al is an element that functions as a deoxidant. To provide the effect, an Al content of 0.005% or more is preferred. Meanwhile, an Al content exceeding 0.10% leads to significant deterioration in the cleanliness of a welded portion during electric resistance welding. Thus, the Al content is limited to 0.005% to 0.10%. The Al content is preferably 0.08% or less.

Nb: 0.01% to 0.10%

Nb is an element having the effect of suppressing the recrystallization and an increase in the size of austenite grains. Nb permits hot finish rolling to be performed in a temperature range in which austenite is not recrystallized. Even if the Nb content is low, Nb has the effect of increasing the strength of a hot rolled steel sheet by the fine precipitation of carbonitride, without impairing weldability. To provide the effect, the Nb content needs to be 0.01% or more. Meanwhile, an excessively high Nb content exceeding 0.10% results in an increase in rolling load during hot finish rolling, making it difficult to perform hot rolling in some cases. Thus, the Nb content is limited to 0.01% to 0.10%. The Nb content is preferably in the range of 0.03% to 0.09%.

Ti: 0.001% to 0.05%

Ti has the effect of preventing the cracking of slab (steel material) by forming a nitride to fix N. Furthermore, the strength of a steel sheet is increased by the fine precipitation of carbide. The effect is significant in a Ti content of 0.001% or more. However, a Ti content exceeding 0.05% results in a marked increase in yield point due to precipitation strengthening. Thus, the Ti content is limited to 0.001% to 0.05%. The Ti content is preferably in the range of 0.005% to 0.035%.

Nb, Ti, and C are contained in amounts described above, and the proportions of Nb, Ti, and C are adjusted in such a manner that the expression (1):

$$(Ti+(Nb/2))/C<4 \quad (1)$$

is satisfied.

Nb and Ti are elements that have a strong tendency to form carbide. It is assumed that in the case of a low C content, most of C is formed into carbide, thereby markedly reducing the amount of solid solution carbon in ferrite grains. However, the marked reduction in the amount of solid solution carbon in ferrite grains adversely affects girth weldability in pipeline construction. The reason for this is as follows: in the case where a steel pipe produced from a steel sheet in which the amount of solid solution carbon in ferrite grains is markedly reduced is used as a transport pipe and where girth weld is performed, significant grain growth is observed in a welded heat affected zone of a girth welded portion, so that the toughness of the welded heat affected zone of the girth welded portion can be deteriorated. Thus, the proportions of Nb, Ti, and C are adjusted to satisfy expression (1). This permits the amount of solid solution carbon in ferrite grains to be 10 ppm or more, thereby preventing the deterioration in the toughness of the welded heat affected zone of the girth welded portion. Furthermore, to suppress a reduction in the strength of the welded portion, the left-hand side of expression (1) is preferably 3 or less.

The foregoing components are basic components. In addition to the basic components, if necessary, one or two or more elements selected from 0.01% to 0.10% V, 0.01% to 0.50% Mo, 0.01% to 1.0% Cr, 0.01% to 0.50% Cu, and 0.01% to 0.50% Ni may be contained as additional elements, and/or 0.0005% to 0.005% Ca may be contained.

One or Two or More Elements Selected From 0.01% to 0.10% V, 0.01% to 0.50% Mo, 0.01% to 1.0% Cr, 0.01% to 0.50% Cu, and 0.01% to 0.50% Ni V, Mo, Cr, Cu, and Ni are each element that improves hardenability and increase the strength of a steel sheet. One or two or more selected therefrom may be contained, as needed.

V is an element that has the effect of improving hardenability and increasing the strength of a steel sheet by the formation of carbonitride. To provide the effect, the V content is preferably 0.01% or more. Meanwhile, an excessively high V content exceeding 0.10% results in a deterioration in weldability. Thus, the V content is preferably limited to 0.01% to 0.10%. More preferably, the V content is in the range of 0.03% to 0.08%.

Mo is an element that has the effect of improving hardenability and increasing the strength of a steel sheet by the formation of carbonitride. To provide the effect, the Mo content is preferably 0.01% or more. Meanwhile, an excessively high Mo content exceeding 0.50% results in a deterioration in weldability. Thus, the Mo content is preferably limited to 0.01% to 0.50%. More preferably, the Mo content is in the range of 0.05% to 0.30%.

Cr is an element that has the effect of improving hardenability and increasing the strength of a steel sheet. To provide the effect, the Cr content is preferably 0.01% or more. Meanwhile, an excessively high Cr content exceeding 1.0% is more liable to cause the formation of weld defects during electric resistance welding. Thus, the Cr content is preferably limited to 0.01% to 1.0%. More preferably, the Cr content is in the range of 0.01% to 0.80%.

Cu is an element that has the effect of improving hardenability and increasing the strength of a steel sheet by solid-solution strengthening or precipitation strengthening. To provide the effect, the Cu content is preferably 0.01% or more. However, a Cu content exceeding 0.50% results in a deterioration in hot workability. Thus, the Cu content is preferably limited to 0.01% to 0.50%. More preferably, the Cu content is in the range of 0.10% to 0.40%.

Ni is an element that has the effect of improving hardenability, increasing the strength of steel, and improving the roughness of a steel sheet. To provide the effect, the Ni content is preferably 0.01% or more. Even if the Ni content exceeds 0.50%, the effect is saturated. Hence, an effect comparable to the Ni content is not provided, which is disadvantageous in cost. Thus, the Ni content is preferably limited to 0.01% to 0.50%. More preferably, the Ni content is in the range of 0.10% to 0.45%.

Ca: 0.0005% to 0.005%

Ca is an element that has the effect of fixing S in the form of CaS, spheroidizing sulfide inclusions to control the forms of inclusions, and reducing the lattice strain of the base metal around the inclusions to reduce the ability to trap hydrogen. A significant effect is provided in a Ca content of 0.0005% or more. However, a Ca content exceeding 0.005% leads to an increase in the CaO content, thereby deteriorating corrosion resistance and toughness. Thus, the Ca content is preferably limited to 0.0005% to 0.005%. More preferably, the Ca content is in the range of 0.0009% to 0.003%.

The balance other than the component described above is Fe and incidental impurities. As the incidental impurities, 0.005% or less N, 0.005% or less 0, 0.003% or less Mg, and 0.005% or less Sn are acceptable.

N: 0.005% or less

N is inevitably contained in steel. An excessively high N content often causes the cracking of a steel material (slab) during casting. Thus, the N content is preferably limited to 0.005% or less. More preferably, the N content is 0.004% or less.

O: 0.005% or less

O is present in steel in the form of various oxides, causing a deterioration in hot workability, corrosion resistance, toughness, and the like. Thus, while the O content is preferably minimized, an O content of 0.005% or less is acceptable. An extreme reduction in the O content leads to an increase in refining cost. Hence, the O content is preferably limited to 0.005% or less.

Mg: 0.003% or less

As with Ca, Mg has the effect of forming oxide and sulfide and suppressing the formation of coarse MnS. A Mg content exceeding 0.003% often causes the formation of clusters of Mg oxide and Mg sulfide, thereby deteriorating toughness. Thus, Mg is preferably limited to 0.003% or less.

Sn: 0.005% or less

Sn is incorporated from scrap used as a raw material for steelmaking Sn is an element that is likely to be segregated in grain boundaries. A high Sn content exceeding 0.005% results in a reduction in the strength of grain boundaries, thereby deteriorating the toughness. Thus, the Sn content is preferably limited to 0.005% or less.

The thick-walled high-strength hot rolled steel sheet has the composition described above and a microstructure in which the difference ΔD between the average grain size (μm) of a ferrite phase serving as a main phase at the position 1 mm from the surface of the steel sheet in the thickness direction and the average grain size (μm) of the ferrite phase serving as the main phase at the middle position of the steel sheet in the thickness direction is 2 μm or less and in which the difference ΔV between the fraction (percent by volume) of a second phase at the position 1 mm from the surface of the steel sheet in the thickness direction and the fraction (percent by volume) of the second phase at the middle position of the steel sheet in the thickness direction is 2% or less. The term "ferrite," which is the main phase of the hot rolled steel sheet, includes bainite, low-temperature transformation products, such as bainitic ferrite, and mixtures thereof. Examples of the second phase include pearlite, martensite, a martensite-austenite constituent (MA), and mixed phases thereof.

Only in the case of a ΔD of 2 μm or less and a ΔV of 2% or less, the low-temperature toughness of the thick-walled high-strength hot rolled steel sheet is significantly improved and, in particular, the DWTT characteristics and the CTOD characteristics using full-thickness test specimens are significantly improved. In the case where one of ΔD and ΔV is outside the range described above, as is clear from FIG. 1, the DWTT is higher than −35° C. to degrade the DWTT characteristics, deteriorating the low-temperature toughness. Thus, the microstructure is limited to a microstructure in which the difference ΔD between the average grain size (μm) of the ferrite phase serving as the main phase at the position 1 mm from the surface of the steel sheet in the thickness direction and the average grain size (μm) of the ferrite phase serving as the main phase at the middle position of the steel sheet in the thickness direction is 2 μm or less and in which the difference ΔV between the fraction (percent by volume) of the second phase at the position 1 mm from the surface of the steel sheet in the thickness direction and the fraction (percent by volume) of the second phase at the middle position of the steel sheet in the thickness direction is 2% or less.

Furthermore, we demonstrate that, in the case of the hot rolled steel sheet having the microstructure with a ΔD of 2 μm or less and a ΔV of 2% or less, the difference ΔD* between the average grain size (μm) of the ferrite phase serving as the main phase at the position 1 mm from the surface of the steel sheet in the thickness direction and the average grain size (μm) of the ferrite phase serving as the main phase at a position away from the surface of the steel sheet in the thickness direction by ¼ of the thickness is 2 μm or less, the difference ΔV* between the fraction (%) of the second phase at the position 1 mm from the surface of the steel sheet in the thickness direction and the fraction (%) of the second phase at the position away from the surface of the steel sheet in the thickness direction by ¼ of the thickness is 2% or less, the difference ΔD between the average grain size (μm) of the ferrite phase serving as the main phase at the position 1 mm from the surface of the steel sheet in the thickness direction and the average grain size (μm) of the ferrite phase serving as the main phase at a position away from the surface of the steel sheet in the thickness direction by ¾ of the thickness is 2 μm or less, and the difference ΔV between the fraction (%) of the second phase at the position 1 mm from the surface of the steel sheet in the thickness direction and the fraction (%) of the second phase at the position away from the surface of the steel sheet in the thickness direction by ¾ of the thickness is 2% or less.

Moreover, the thick-walled high-strength hot rolled steel sheet preferably has uniform mill scale having a thickness of 3 to 30 μm on a surface of the steel sheet.

In the case where the mill scale formed on the surface has a thickness of less than 3 μm, the heat transfer coefficient is reduced compared with the case of a larger thickness, leading to a reduction in tensile strength as illustrated in FIG. 4A. This results in an increase in cooling stop temperature at the middle position of the steel sheet in the thickness direction, causing a deterioration in toughness. In the case where the mill scale partially has a thickness of less than 3 μm, uneven cooling occurs to cause a local reduction in strength. In the case where the mill scale has a thickness exceeding 30 μm, the heat transfer coefficient is increased compared with the case of a smaller thickness, leading to an increase in tensile strength as illustrated in FIG. 4A. This results in an excessive increase in the strength of the surface layer portion, causing a deterioration in toughness. In the case where the mill scale partially has a thickness exceeding 30 μm, uneven cooling occurs to cause a local increase in strength, thereby leading to a deterioration in ductility. Thus, the thickness of the mill scale formed on the surface is limited to 3 to 30 μm. In the case where the thickness of the mill scale formed on the surface is adjusted within this range, variations in strength and ductility at positions in the steel sheet are reduced, thereby improving the uniformity of the material at the positions in the steel sheet.

Furthermore, preferably, the hot rolled steel sheet has the foregoing composition, the foregoing microstructure, and a hardness distribution in which the difference ΔHV between the Vickers hardness $HV_{1mm}$ at the position 1 mm from the surface of the steel sheet in the thickness direction and the Vickers hardness $HV_{1/2t}$ at the middle position of the steel sheet in the thickness direction is 50 points or less.

A ΔHV exceeding 50 points is liable to cause a local increase in strength, thereby deteriorating the pipe formability and deteriorating the circularity a pipe. Thus, the difference ΔHV between $HV_{1mm}$ and $HV_{1/2t}$ is limited to 50 points or less.

In addition, preferably, the hot rolled steel sheet has the foregoing composition, the foregoing microstructure, and the microstructure in which the minimum lath spacing of the bainite phase (including bainitic ferrite phase) or the tempered martensitic phase is 0.1 μm or more at the position 1 mm from the surface of the steel sheet in the thickness direction.

The hot rolled steel sheet having the structure has excellent pipe formability.

A preferred method for producing the hot rolled steel sheet will be described below.

With respect to a method for producing a steel material, preferably, molten steel having the foregoing composition is made by a common method with a converter or the like and formed into a steel material, such as a slab, by a common casting method, such as a continuous casting process. However, this disclosure is not limited to the method.

The steel material having the composition is heated and subjected to hot rolling. The hot rolling includes rough rolling that forms the steel material into a sheet bar and finish rolling that forms the sheet bar into a hot rolled steel sheet.

The heating temperature of the steel material may be a temperature at which the steel material can be rolled into a hot rolled steel sheet. While the heating temperature need not be particularly limited, the heating temperature is preferably in the range of 1100° C. to 1300° C. A heating temperature of less than 1100° C. results in a high resistance to distortion, increasing the rolling load to cause an excessively high load on a rolling mill. A heating temperature exceeding 1300° C. results in coarse crystal grains, deteriorating the low-temperature toughness, increasing the amount of scale formed, and reducing the yield. Thus, the heating temperature during the hot rolling is preferably in the range of 1100° C. to 1300° C.

The heated steel material is subjected to rough rolling into a sheet bar. The conditions of the rough rolling are not particularly limited as long as a sheet bar having desired dimensions is formed. From the viewpoint of ensuring low-temperature toughness, the rolling end temperature of the rough rolling is preferably 1050° C. or lower.

The steel material is subjected to scale removal treatment, in which primary scale formed on the surface of the steel material by heating is removed with a rough scale breaker (RSB) for a roughing mill, before the rough rolling. The scale removal treatment may be repeatedly performed in the course of the rough rolling in addition to before the rough rolling. To adjust the thickness of mill scale of the product (hot rolled steel sheet) in an appropriate range, it is preferred that an excessive use of the scale breaker is avoided.

The resulting sheet bar is then subjected to finish rolling. The finish rolling start temperature is preferably adjusted by subjecting the sheet bar to accelerated cooling before the finish rolling or to, for example, oscillation on a table. This permits a reduction rate (effective reduction rate) in a finishing mill to be increased in a temperature region effective in improving the toughness. A temperature used in the finish rolling is indicated by a temperature of the surface.

In the finish rolling, preferably, the finish entry temperature (FET) is set in the range of 800° C. to 1050° C., and the finish delivery temperature (FDT) is set in the range of 750° C. to 950° C. At a finish delivery temperature (FDT) of less than 800° C., a portion in the vicinity of the surface is excessively cooled, so that the portion can have a temperature of less than the $Ar_3$ transformation point, thereby leading to a nonuniform microstructure in the thickness direction to deteriorate the toughness. An FET exceeding 1050° C. can cause the formation of secondary scale in the finishing mill, making it difficult to adjust the thickness of the mill scale in a desired appropriate range. At a finish delivery temperature (FDT) of less than 750° C., the portion in the vicinity of the surface can have a temperature of less than the $Ar_3$ transformation point, thereby leading to a nonuniform microstructure in the thickness direction to deteriorate the toughness. An FDT exceeding 950° C. results in the formation of secondary scale in the finishing mill, making it difficult to adjust the thickness of the mill scale in a desired appropriate range.

The finish entry temperature is preferably adjusted by subjecting the sheet bar to accelerated cooling before the finish rolling or to, for example, oscillation on the table. This permits a reduction rate in a finishing mill to be increased in a temperature region effective in improving the toughness. Furthermore, the steel material is subjected to scale removal treatment, in which secondary scale formed on the sheet bar is removed with a finish scale breaker (FSB) for the finishing mill, before the finish rolling. The scale removal treatment may be repeatedly performed by cooling between stands of the finishing mill in addition to before the finish rolling. The sheet bar preferably has a temperature of 800° C. to 1050° C. during the scale removal treatment. To adjust the thickness of mill scale of the product (hot rolled steel sheet) in an appropriate range, it is preferred that an excessive use of the scale breaker is avoided. The scale removal treatment can also adjust the finish entry temperature.

In the finish rolling, the effective reduction rate is preferably set to 20% or more from the viewpoint of improving the toughness. The term "effective reduction rate" indicates the total amount of rolling reduction (%) at temperatures of 950° C. or less. To achieve a desired increase in toughness in the entire thickness, the effective reduction rate at the middle position of the steel sheet in the thickness direction preferably satisfies 20% or more. After the completion of the hot rolling (finish rolling), the hot rolled steel sheet is preferably subjected to accelerated cooling on the hot run table. The accelerated cooling is preferably initiated when the middle position of the steel sheet in the thickness direction has a temperature of 750° C. or higher. In the case where the temperature at the middle position of the steel sheet in the thickness direction is less than 750° C., high-temperature transformation ferrite (polygonal ferrite) is formed, so that C ejected during the $\gamma$ to $\alpha$ transformation forms a second phase around polygonal ferrite. Thus, the fraction of the second phase is increased at the middle position of the steel sheet in the thickness direction, failing to the desired microstructure described above.

The accelerated cooling is preferably performed to a cooling stop temperature of BFS or lower at an average cooling rate of 10° C./s or more at the middle position of the steel sheet in the thickness direction. The average cooling rate is defined as an average cooling rate in the temperature range of 750° C. to 650° C.

A cooling rate of less than 10° C./s is liable to cause the formation of high-temperature transformation ferrite (polygonal ferrite). Thus, the fraction of the second phase is increased at the middle position of the steel sheet in the thickness direction, failing to the desired microstructure described above. Hence, the accelerated cooling after the completion of the hot rolling is preferably performed at an average cooling rate of 10° C./s or more at the middle position of the steel sheet in the thickness direction. More preferably, the average cooling rate is set to 20° C./s or more. The upper limit of the cooling rate is determined, depending on the ability of a cooling apparatus used. The upper limit is preferably lower than a martensite-forming cooling rate, which is a cooling rate without a deterioration in the shape of the steel sheet, for example, camber. The cooling rate can be achieved with a water cooler using, for example, a flat nozzle, a rod-like nozzle, or a circular-tube nozzle.

Values of the temperature at the middle position of the steel sheet in the thickness direction, the cooling rate, the coiling temperature, and the like are determined using heat transfer calculation or the like.

The cooling stop temperature in the accelerated cooling is preferably BFS or lower at the middle position of the steel sheet in the thickness direction. More preferably, the cooling stop temperature is (BFS−20° C.) or lower. BFS is defined by the expression (2):

$$BFS\ (^\circ\ C.)=770-300C-70Mn-70Cr-170Mo-40Cu-40Ni-1.5CR \quad (2)$$

(wherein C, Mn, Cr, Mo, Cu, and Ni each represent the proportion thereof (percent by mass), and CR represents the average cooling rate (° C./s) at the middle position of the steel sheet in the thickness direction). After the termination of the accelerated cooling at the foregoing cooling stop temperature or lower, the hot rolled steel sheet is coiled at a coiling temperature of BFS0 or lower at the middle position of the steel sheet in the thickness direction. More preferably, the coiling temperature is (BFS0−20° C.) or lower. BFS0 is defined by the expression (3):

$$BFS0\ (^\circ\ C.)=770-300C-70Mn-70Cr-170Mo-40Cu-40Ni \quad (3)$$

(wherein C, Mn, Cr, Mo, Cu, and Ni each represent the proportion thereof (percent by mass)).

As illustrated in FIGS. 2 and 3, a cooling stop temperature in the accelerated cooling of BFS or lower and a coiling temperature of BFS0 or lower result in a ΔD of 2 μm or less and a ΔV of 2% or less, providing the extremely uniform microstructure in the thickness direction. This ensured excellent DWTT characteristics and excellent CTOD characteristics, providing the thick-walled high-strength hot rolled steel sheet having significantly improved low-temperature toughness.

The coiled hot rolled steel sheet is preferably cooled to room temperature at a cooling rate of 20 to 60° C./hr at the middle portion of the coil (the middle portion of the coil in the longitudinal direction). A cooling rate of less than 20° C./hr can lead to a deterioration in toughness due to the progress of crystal grain growth. A cooling rate exceeding 60° C./hr is liable to cause an increase in the difference in temperature between the middle portion of the coil and the outer and inner portions of the coil, thereby deteriorating the shape of the coil.

Our steel sheets and methods will be described in detail below on the basis of examples.

Example 1

Slabs (steel materials) (thickness: 220 mm) having compositions described in Table 1 were subjected to hot rolling under hot rolling conditions described in Table 2. After the completion of the hot rolling, the resulting hot rolled steel sheets were cooled under cooling conditions described in Table 2 and coiled at coiling temperatures described in Table 2 to provide hot rolled steel sheets (steel strips) having thicknesses described in Table 2. The hot rolled steel sheets were continuously formed into open tubes by cold forming. The end faces of the open tubes were subjected to electric-resistance welding to provide electric resistance welded steel pipes (outer diameter: 660 mm).

Test specimens were taken from the resulting hot rolled steel sheets. Microstructure observation, a tensile test, an impact test, a DWTT test, and a CTOD test were conducted. The electric resistance welded steel pipes were also subjected to the DWTT test and the CTOD test. Methods of the tests were described below.

(1) Microstructure Observation

Test specimens for microstructure observation were taken from the hot rolled steel sheets. Cross sections in the rolling direction were polished and etched. Each test specimen was observed in two or more fields of view using an optical microscope (magnification: 1000×) or a scanning electron microscope (magnification: 1000×). Images of each test specimen were taken. The average grain size of a ferrite phase serving as a main phase (indicates hard low-temperature transformation ferrite and includes bainitic ferrite, bainite, and a mixed phase thereof) and the fraction (percent by volume) of a second phase (pearlite, martensite, a martensite-austenite constituent (MA), and a mixed phase thereof) other than the ferrite phase serving as the main phase were measured with an image analysis system. Observation positions were set to a position 1 mm from a surface of each steel sheet in the thickness direction and the middle position of each steel sheet in the thickness direction. The average grain size of the ferrite phase serving as the main phase was determined by an intercept method. A nominal grain size was defined as the average grain size at the position.

(2) Tensile Test

Plate-like test specimens (width of parallel portion: 25 mm, gage length: 50 mm) were taken from the resulting hot rolled steel sheets in such a manner that a direction (c direction) orthogonal to a rolling direction was a tensile test direction. A tensile test was performed at room temperature in conformity with the regulation of ASTM E8M-04, and the tensile strength TS was determined.

(3) Impact Test

V-notch test specimens were taken from the middle positions of the resulting hot rolled steel sheets in the thickness direction in such a manner that the direction (c direction) orthogonal to the rolling direction was a longitudinal direction. The Charpy impact test was performed in conformity with the regulation of JIS Z 2242. Absorbed energy (J) at a test temperature of −80° C. was determined. Three test specimens were used. The arithmetic mean of the resulting absorbed energy values was determined and defined as $vE_{-80}$ (J), which was the absorbed energy of the steel sheet. In the case where $vE_{-80}$ was 300 J or more, the steel sheet was evaluated to have "satisfactory toughness."

(4) DWTT Test

DWTT test specimens (dimensions: thickness×3 in. wide×12 in. long) were taken from the resulting hot rolled steel sheets in such a manner that the direction (c direction) orthogonal to the rolling direction was a longitudinal direction. A DWTT test was performed in conformity with the regulation of ASTM E 436. The lowest temperature (DWTT) when the percent shear fracture was 85% was determined. In the case where DWTT was −35° C. or lower, the steel sheet was evaluated to have "excellent DWTT characteristics."

In the DWTT test, DWTT test specimens were also taken from base metal of the electric resistance welded steel pipes and tested in the same way as the steel sheets.

(5) CTOD Test

CTOD test specimens (dimensions: thickness×width (2×thickness)×length (10×thickness)) were taken from the resulting hot rolled steel sheets in such a manner that the direction (c direction) orthogonal to the rolling direction was a longitudinal direction. A CTOD test was performed in conformity with the regulation of ASTM E 1290 at a test temperature of −10° C. A critical opening displacement (CTOD value) at −10° C. was determined. A test load was applied by three-point bending. A displacement gage was attached to a notched portion, and the critical opening displacement (CTOD value) was measured. In the case where the CTOD value was 0.30 mm or more, the steel sheet was evaluated to have "excellent CTOD characteristics."

In the CTOD test, CTOD test specimens were also taken from the electric resistance welded steel pipes in such a manner that a direction orthogonal to the direction of tube axis was the longitudinal direction of the test specimens. Notches were made in base metal and seam portions. The test specimens were tested in the same way as the steel sheets.

Table 3 shows the results.

In each of the examples, the hot rolled steel sheet has an appropriate microstructure, a high tensile strength TS of 521 MPa or more, and excellent low-temperature toughness, in which $vE_{-80}$ is 300 J or more, the CTOD value is 0.30 mm or more, and DWTT is −35° C. or lower. In particular, the hot rolled steel sheet has excellent CTOD characteristics and excellent DWTT characteristics. Furthermore, in each of the electric resistance welded steel pipes made from the hot rolled steel sheets of the examples, at both of the base metal and the seam portion, the CTOD value is 0.30 mm or more, and DWTT is −20° C. or lower. That is, the steel pipes have excellent low-temperature toughness.

In contrast, in the comparative examples outside our range, $vE_{-80}$ is less than 300 J, the CTOD value is less than 0.30 mm, or DWTT exceeds −35° C. That is, the steel sheets have deteriorated low-temperature toughness. For a comparative example (steel sheet 5), in which the cooling rate after the completion of the hot rolling is lower than our range, the difference ΔV of the fractions of the second phase exceeds 2%, so that the steel sheet has deteriorated low-temperature toughness. For a comparative example (steel sheet 4), in which the cooling stop temperature in the accelerated cooling is higher than our range, ΔD exceeds 2 μm, so that the steel sheet has deteriorated low-temperature toughness. For a comparative example (steel sheet 8), in which the cooling stop temperature in the accelerated cooling is higher than our range and in which the coiling temperature is higher than our range, ΔD exceeds 2 μm, and ΔV exceeds 2%, so that the steel sheet has deteriorate low-temperature toughness. For a comparative example (steel sheet 14), in which the composition of the steel sheet does not satisfy expression (1), ΔD exceeds 2 μm, so that the steel sheet has deteriorated low-temperature toughness. For the electric resistance welded steel pipes made from the steel sheets, the base metal and the seam portions have deteriorated low-temperature toughness.

Example 2

Slabs (steel materials) (thickness: 230 mm) having compositions described in Table 4 were subjected to hot rolling under hot rolling conditions described in Table 5. After the completion of the hot rolling, the resulting hot rolled steel sheets were cooled under cooling conditions described in Table 5 and coiled at coiling temperatures described in Table 5 to provide hot rolled steel sheets (steel strips) having thicknesses described in Table 5. The hot rolled steel sheets were continuously formed into open tubes by cold forming. The end faces of the open tubes were subjected to electric-resistance welding to provide electric resistance welded steel pipes (outer diameter: 660 mm).

Test specimens were taken from the resulting hot rolled steel sheets. Microstructure observation, a tensile test, an impact test, a DWTT test, and a CTOD test were conducted. The electric resistance welded steel pipes were also subjected to the DWTT test and the CTOD test. Methods of the tests were described below.

(1) Microstructure Observation

Test specimens for microstructure observation were taken from the hot rolled steel sheets. Cross sections in the rolling direction were polished and etched. Each test specimen was observed in two or more fields of view using an optical microscope (magnification: 1000×) or a scanning electron microscope (magnification: 1000×). Images of each test specimen were taken. The average grain size of a ferrite phase serving as a main phase (indicates hard low-temperature transformation ferrite and includes bainitic ferrite, bainite, and a mixed phase thereof) and the fraction (percent by volume) of a second phase (pearlite, martensite, a martensite-austenite constituent (MA), and a mixed phase thereof) other than the ferrite phase serving as the main phase were measured with an image analysis system. Observation positions were set to a position 1 mm from a surface of each steel sheet in the thickness direction and the middle position of each steel sheet in the thickness direction. The average grain size of the ferrite phase serving as the main phase was determined by an intercept method. A nominal grain size was defined as the average grain size at the position.

Test specimens for the measurement of the thickness of mill scale were taken from points (four points at intervals of 40 m in the longitudinal direction) of each of the resulting hot rolled steel sheets in the longitudinal direction and points (four points at intervals of 0.4 m in the width direction) in the width direction. Cross sections in the rolling direction were polished. The mill scale thicknesses were measured with the optical microscope or the scanning electron microscope. The average mill scale thickness ts, which is the average value of the resulting mill scale thicknesses, and the difference Δts between the maximum value and the minimum value of the mill scale thicknesses at the points were calculated.

(2) Tensile Test

Plate-like test specimens (width of parallel portion: 25 mm, gage length: 50 mm) were taken from points (four points at intervals of 40 m in the longitudinal direction) of each of the resulting hot rolled steel sheets in the longitudinal direction and points (four points at intervals of 0.4 m in the width direction) in the width direction in such a manner that a direction (c direction) orthogonal to a rolling direction was the longitudinal direction. A tensile test was performed at room temperature in conformity with the regulation of ASTM E8M-04, and the tensile strength TS was determined. The difference between the minimum value and the maximum value of the values of the tensile strength TS at the points was determined and defined as variations ΔTS. The variations in tensile strength at the points of each steel sheet were evaluated. In the case where ΔTS was 35 MPa or lower, the steel sheet was evaluated to be uniform.

(3) Impact Test

V-notch test specimens were taken from points (four points at intervals of 40 m in the longitudinal direction) of each of the resulting hot rolled steel sheets in the longitudinal direction and points (four points at intervals of 0.4 m in the width direction) in the width direction, the points being located at the middle positions of the resulting hot rolled steel sheets in the thickness direction, in such a manner that the direction (c direction) orthogonal to the rolling direction was the longitudinal direction. The Charpy impact test was performed in conformity with the regulation of JIS Z 2242. Absorbed energy (J) at a test temperature of −80° C. was determined. Three test specimens were used. The arithmetic mean of the resulting absorbed energy values was determined and defined as $vE_{-80}$ (J), which was the absorbed energy of the steel sheet. In the case where $vE_{-80}$ was 300 J or more, the steel sheet was evaluated to have "satisfactory toughness." The difference between the minimum value and the maximum value of the values of $vE_{-80}$ at the points was determined and defined as variations $\Delta vE_{-80}$. The variations in toughness at the points of each steel sheet were evaluated. In the case where $\Delta vE_{-80}$ was 45 J or less, the steel sheet was evaluated to be uniform.

(4) DWTT Test

DWTT test specimens (dimensions: thickness×3 in. wide×12 in. long) were taken from the resulting hot rolled steel sheets in such a manner that the direction (c direction) orthogonal to the rolling direction was a longitudinal direction. A DWTT test was performed in conformity with the regulation of ASTM E 436. The lowest temperature (DWTT) when the percent shear fracture was 85% was determined. In the case where DWTT was −35° C. or lower, the steel sheet was evaluated to have "excellent DWTT characteristics."

In the DWTT test, DWTT test specimens were also taken from base metal of the electric resistance welded steel pipes and tested in the same way as the steel sheets.

(5) CTOD Test

CTOD test specimens (dimensions: thickness t×width (2×t)×length (10×t)) were taken from the resulting hot rolled steel sheets in such a manner that the direction (c direction) orthogonal to the rolling direction was a longitudinal direction. A CTOD test was performed in conformity with the regulation of ASTM E 1290 at a test temperature of −10° C. A critical opening displacement (CTOD value) at −10° C. was determined. A test load was applied by three-point bending. A displacement gage was attached to a notched portion, and the critical opening displacement (CTOD value) was measured. In the case where the CTOD value was 0.30 mm or more, the steel sheet was evaluated to have "excellent CTOD characteristics."

In the CTOD test, CTOD test specimens were also taken from the electric resistance welded steel pipes in such a manner that a direction orthogonal to the direction of tube axis was the longitudinal direction of the test specimens. Notches were made in base metal and seam portions. The test specimens were tested in the same way as the steel sheets.

Table 6 shows the results.

In each of the examples, the hot rolled steel sheet has mill scale with an appropriate thickness, an appropriate microstructure, a high tensile strength TS of 510 MPa or more, and excellent low-temperature toughness, in which $vE_{-80}$ is 300 J or more, the CTOD value is 0.30 mm or more, and DWTT is −35° C. or lower. Furthermore, the hot rolled steel sheet has only small nonuniformity of the material in the longitudinal direction and width direction of the sheet and has a uniform material. In particular, the hot rolled steel sheet has excellent CTOD characteristics and excellent DWTT characteristics. Furthermore, in each of the electric resistance welded steel pipes made from the hot rolled steel sheets of the examples, at both of the base metal and the seam portion, the CTOD value is 0.30 mm or more, and DWTT is −20° C. or lower. That is, the steel pipes have excellent low-temperature toughness.

In contrast, in the comparative examples outside our range, $vE_{-80}$ is less than 300 J, the CTOD value is less than 0.30 mm, or DWTT exceeds −35° C. That is, the steel sheets have deteriorated low-temperature toughness. Furthermore, the mill scale thicknesses vary widely. The nonuniformity of the material is increased in the longitudinal direction and the width direction of each sheet. For a comparative example (steel sheet 5), in which the cooling rate after the completion of the hot rolling is lower than our range, the difference ΔV of the fractions of the second phase exceeds 2%, so that the steel sheet has deteriorated low-temperature toughness. For a comparative example (steel sheet 4), in which the cooling stop temperature in the accelerated cooling is higher than our range, the average thickness of the mill scale exceeds 30 μm, and there are variations in mill scale thickness. ΔD exceeds 2 μm, so that the steel sheet has deteriorated low-temperature toughness. In addition, the tensile strength ΔTS varies widely. For a comparative example (steel sheet 3), in which the cooling rate in the accelerated cooling is lower than our range and in which the coiling temperature is higher than our range, the average thickness of the mill scale is less than 3 μm, and ΔV exceeds 2%, so that the steel sheet has deteriorated low-temperature toughness. For a comparative example (steel sheet 7), in which the scale removal treatment is not performed with the scale breaker before the rough rolling, the average thickness of the mill scale exceeds 30 μm, the mill scale thicknesses vary widely, and the tensile strength ΔTS varies widely. For a comparative example (steel sheet 8), in which the scale removal treatment is not performed with the scale breaker before the finish rolling and in which the coiling temperature is higher than our range, the average thickness of the mill scale exceeds 30 μm, the mill scale thicknesses vary widely, and the tensile strength ΔTS varies widely. Furthermore, ΔD exceeds 2 μm, and ΔV exceeds 2%, so that the steel sheet has deteriorated low-temperature toughness. For a comparative example (steel sheet 15), in which the composition of the steel sheet does not satisfy expression (1), ΔD exceeds 2 μm, so that the steel sheet has deteriorated low-temperature toughness. For the electric resistance welded steel pipes made from the steel sheets, the base metal and the seam portions have deteriorated low-temperature toughness.

Example 3

Slabs (steel materials) (thickness: 230 mm) having compositions described in Table 7 were subjected to hot rolling under hot rolling conditions described in Table 8. After the completion of the hot rolling, the resulting hot rolled steel sheets were cooled under cooling conditions described in Table 8 and coiled at coiling temperatures described in Table 8 to provide hot rolled steel sheets (steel strips) having thicknesses described in Table 8. The hot rolled steel sheets were continuously formed into open tubes by cold forming. The end faces of the open tubes were subjected to electric-resistance welding to provide electric resistance welded steel pipes (outer diameter: 660 mm).

Test specimens were taken from the resulting hot rolled steel sheets. Microstructure observation, a hardness test, a tensile test, an impact test, a DWTT test, and a CTOD test were conducted. The electric resistance welded steel pipes were also subjected to the DWTT test and the CTOD test. Methods of the tests were described below.

(1) Microstructure Observation

Test specimens for microstructure observation were taken from the hot rolled steel sheets. Cross sections in the rolling direction were polished and etched. Each test specimen was observed in two or more fields of view using an optical microscope (magnification: 1000×) or a scanning electron microscope (magnification: 2000×). Images of each test specimen were taken. The average grain size of a ferrite phase serving as a main phase (indicates hard low-temperature transformation ferrite and includes bainitic ferrite, bainite, and a mixed phase thereof) and the fraction (percent by volume) of a second phase (pearlite, martensite, a martensite-austenite constituent (MA), and a mixed phase thereof) other than the ferrite phase serving as the main phase were measured with an image analysis system. Observation positions were set to a position 1 mm from a surface of each steel sheet in the thickness direction and the middle position of each steel sheet in the thickness direction. The average grain size of the ferrite phase serving as the main phase was determined by measuring areas of ferrite grains, calculating the diameters of the equivalent circles from the areas, and determining the arithmetic mean of the diameters of the equivalent circles of the ferrite grains.

(2) Hardness Test

Test specimens for microstructure observation were taken from the hot rolled steel sheets. Hardness HV in each cross section in the rolling direction was measured with a Vickers hardness tester (test load: 98 N (load: 10 kgf)). Measurement positions were set to the positions 1 mm from the surfaces of the steel sheets in the thickness direction and the middle positions of the steel sheets in the thickness direction. The hardness measurement was performed at three points in each position. The arithmetic mean of the measurement results were determined and defined as the hardness at each position. The difference ΔHV ($=HV_{1mm}-HV_{1/2t}$) between the hardness $HV_{1mm}$ at the position 1 mm from the surface of the steel sheet in the thickness direction and the hardness $HV_{1/2t}$ at the middle position of the steel sheet in the thickness direction was calculated from the resulting hardness at each position.

(3) Tensile Test

Plate-like test specimens (width of parallel portion: 25 mm, gage length: 50 mm) were taken from the resulting hot rolled steel sheets in such a manner that a direction (c direction) orthogonal to a rolling direction was the longitudinal direction. A tensile test was performed at room temperature in conformity with the regulation of ASTM E8M-04, and the tensile strength TS was determined.

(4) Impact Test

V-notch test specimens were taken from the middle positions of the resulting hot rolled steel sheets in the thickness direction in such a manner that the direction (c direction) orthogonal to the rolling direction was a longitudinal direction. The Charpy impact test was performed in conformity with the regulation of JIS Z 2242. Absorbed energy (J) at a test temperature of −80° C. was determined. Three test specimens were used. The arithmetic mean of the resulting absorbed energy values was determined and defined as $vE_{-80}$ (J), which was the absorbed energy of the steel sheet. In the case where $vE_{-80}$ was 200 J or more, the steel sheet was evaluated to have "satisfactory toughness."

(5) DWTT Test

DWTT test specimens (dimensions: thickness×3 in. wide×12 in. long) were taken from the resulting hot rolled steel sheets in such a manner that the direction (c direction) orthogonal to the rolling direction was a longitudinal direction. A DWTT test was performed in conformity with the regulation of ASTM E 436. The lowest temperature (DWTT) when the percent shear fracture was 85% was determined. In the case where DWTT was −35° C. or lower, the steel sheet was evaluated to have "excellent DWTT characteristics."

In the DWTT test, DWTT test specimens were also taken from base metal of the electric resistance welded steel pipes and tested in the same way as the steel sheets.

(6) CTOD Test

CTOD test specimens (dimensions: thickness×width (2×thickness)×length (10×thickness)) were taken from the resulting hot rolled steel sheets in such a manner that the direction (c direction) orthogonal to the rolling direction was a longitudinal direction. A CTOD test was performed in conformity with the regulation of ASTM E 1290 at a test temperature of −10° C. A critical opening displacement (CTOD value) at −10° C. was determined. A test load was applied by three-point bending. A displacement gage was attached to a notched portion, and the critical opening displacement (CTOD value) was measured. In the case where the CTOD value was 0.30 mm or more, the steel sheet was evaluated to have "excellent CTOD characteristics."

In the CTOD test, CTOD test specimens were also taken from the electric resistance welded steel pipes in such a manner that a direction orthogonal to the direction of tube axis was the longitudinal direction of the test specimens. Notches were made in base metal and seam portions. The test specimens were tested in the same way as the steel sheets.

Table 9 shows the results. The circularity of each of the resulting electric resistance welded steel pipes was measured.

(7) Measurement of Circularity

The outer diameter of each of the steel pipes was measured at a cross section orthogonal to the longitudinal direction of the steel pipe. According to JIS B 0182, the circularity of the cross section of the pipe was determined using the following expression:

$$\text{Circularity (\%)}=\{(\text{maximum outer diameter}-\text{minimum outer diameter})/(\text{nominal diameter})\}\times 100.$$

In the case where the circularity was less than 0.90%, the pipe had good circularity (good).

In each of the examples, the hot rolled steel sheet has, in the thickness direction, an appropriate microstructure, an appropriate difference in hardness, a high tensile strength TS of 521 MPa or more, and excellent low-temperature toughness, in which $vE_{-80}$ is 200 J or more, the CTOD value is 0.30 mm or more, and DWTT is −35° C. or lower. In particular, the hot rolled steel sheet has excellent CTOD characteristics and excellent DWTT characteristics. Furthermore, in each of the electric resistance welded steel pipes made from the hot rolled steel sheets of the examples, at both of the base metal and the seam portion, the CTOD value is 0.30 mm or more, and DWTT is −20° C. or lower. That is, the steel pipes have excellent low-temperature toughness. The circularity of each of the electric resistance welded steel pipes made from the hot rolled steel sheets of the examples is less than 0.90%, which is satisfactory.

In contrast, in the comparative examples outside our range, $vE_{-80}$ is less than 200 J, the CTOD value is less than 0.30 mm, DWTT exceeds −35° C., or ΔHV exceeds 50 points. The circularity is 0.90% or more, which is degraded. For a comparative example (steel sheet 3), in which the cooling rate after the completion of the hot rolling is lower than our range, the difference ΔV of the fractions of the second phase exceeds 2%, so that the steel sheet has deteriorated low-temperature toughness. For a comparative example (steel sheet 15), in which the cooling stop temperature in the accelerated cooling is higher than our range, ΔD exceeds 2 μm, so that the steel sheet has deteriorated low-temperature toughness. For a comparative example (steel sheet 6), in which the cooling stop temperature in the accelerated cooling is higher than our range and in which the coiling temperature is higher than our range, ΔD exceeds 2 μm, and ΔV exceeds 2%, so that the steel sheet has deteriorated low-temperature toughness. For a comparative example (steel sheet 16), in which the composition of the steel sheet does not satisfy expression (1), the CTOD value at the seam portion of the electric resistance welded steel pipe is less than 0.30 mm, so that the pipe has deteriorated low-temperature toughness. For a comparative example (steel sheet 11), in which the cooling rate in the accelerated cooling at the position 1 mm from the surface of the steel sheet in the thickness direction is higher than our range because of the carbon equivalent Ceq and in which ΔHV exceeds 50 points, which is outside our range, the circularity is deteriorated to be 0.90%.

Example 4

Slabs (steel materials) (thickness: 215 mm) having compositions described in Table 10 were subjected to hot rolling under hot rolling conditions described in Table 11. After the completion of the hot rolling, the resulting hot rolled steel sheets were cooled under cooling conditions described in Table 11 and coiled at coiling temperatures described in Table 11 to provide hot rolled steel sheets (steel strips) having thicknesses described in Table 11. The hot rolled steel sheets were continuously formed into open tubes by cold forming. The end faces of the open tubes were subjected to electric-resistance welding to provide electric resistance welded steel pipes (outer diameter: 660 mm).

Test specimens were taken from the resulting hot rolled steel sheets. Microstructure observation, a tensile test, an impact test, a DWTT test, and a CTOD test were conducted. The electric resistance welded steel pipes were also subjected to the DWTT test and the CTOD test. Methods of the tests were described below.

(1) Microstructure Observation

Test specimens for microstructure observation were taken from the hot rolled steel sheets. Cross sections in the rolling direction were polished and etched. Each test specimen was observed in two or more fields of view using an optical microscope (magnification: 1000×) or a scanning electron microscope (magnification: 2000×). Images of each test specimen were taken. The average grain size of a ferrite phase serving as a main phase (indicates hard low-temperature transformation ferrite and includes bainitic ferrite and bainite) and the fraction (percent by volume) of a second phase (pearlite, martensite, a martensite-austenite constituent (MA), and a mixed phase thereof) other than the ferrite phase serving as the main phase were measured with an image analysis system. Observation positions were set to a position 1 mm from a surface of each steel sheet in the thickness direction and the middle position of each steel sheet in the thickness direction. The average grain size of the ferrite phase serving as the main phase was determined by measuring areas of ferrite grains, calculating the diameters of the equivalent circles from the areas, and determining the arithmetic mean of the diameters of the equivalent circles of the ferrite grains.

Thin film specimens were taken from positions 1 mm from surfaces of the steel sheets in the thickness direction. Each thin film specimen was observed in three or more fields of view with a transmission electron microscope (magnification: 50,000×). Images of each thin film specimen were taken. The lath spacing of bainite (including bainitic ferrite) or tempered martensite was measured. Among the resulting lath spacing values, the minimum lath spacing value was determined.

(2) Tensile Test

Plate-like test specimens (width of parallel portion: 25 mm, gage length: 50 mm) were taken from the resulting hot rolled steel sheets in such a manner that a direction (c direction) orthogonal to a rolling direction was a longitudinal direction. A tensile test was performed at room temperature in conformity with the regulation of ASTM E8M-04, and the tensile strength TS was determined.

(3) Impact Test

V-notch test specimens were taken from the middle positions of the resulting hot rolled steel sheets in the thickness direction in such a manner that the direction (c direction) orthogonal to the rolling direction was a longitudinal direction. The Charpy impact test was performed in conformity with the regulation of JIS Z 2242. Absorbed energy (J) at a test temperature of −80° C. was determined. Three test specimens were used. The arithmetic mean of the resulting absorbed energy values was determined and defined as $vE_{-80}$ (J), which was the absorbed energy of the steel sheet. In the case where $vE_{-80}$ was 250 J or more, the steel sheet was evaluated to have "satisfactory toughness."

(4) DWTT Test

DWTT test specimens (dimensions: thickness×3 in. wide×12 in. long) were taken from the resulting hot rolled steel sheets in such a manner that the direction (c direction) orthogonal to the rolling direction was a longitudinal direction. A DWTT test was performed in conformity with the regulation of ASTM E 436. The lowest temperature (DWTT) when the percent shear fracture was 85% was determined. In the case where DWTT was −50° C. or lower, the steel sheet was evaluated to have "excellent DWTT characteristics."

In the DWTT test, DWTT test specimens were also taken from base metal of the electric resistance welded steel pipes and tested in the same way as the steel sheets.

(5) CTOD Test

CTOD test specimens (dimensions: thickness×width (2×thickness)×length (10×thickness)) were taken from the resulting hot rolled steel sheets in such a manner that the direction (c direction) orthogonal to the rolling direction was a longitudinal direction. A CTOD test was performed in conformity with the regulation of ASTM E 1290 at a test temperature of −10° C. A critical opening displacement (CTOD value) at −10° C. was determined. A test load was applied by three-point bending. A displacement gage was attached to a notched portion, and the critical opening displacement (CTOD value) was measured. In the case where the CTOD value was 0.30 mm or more, the steel sheet was evaluated to have "excellent CTOD characteristics."

In the CTOD test, CTOD test specimens were also taken from the electric resistance welded steel pipes in such a manner that a direction orthogonal to the direction of tube axis was the longitudinal direction of the test specimens. Notches were made in base metal and seam portions. The test specimens were tested in the same way as the steel sheets.

Table 12 shows the results. The circularity of each of the resulting electric resistance welded steel pipes was investigated. The outer diameter of each of the steel pipes was measured at a cross section orthogonal to the axial direction of the steel pipe. According to JIS B 0182, the circularity was determined using {(maximum outer diameter−minimum outer diameter)/(nominal diameter)}×100(%).

In each of the examples, the hot rolled steel sheet has, in the thickness direction, an appropriate microstructure, a high tensile strength TS of 510 MPa or more, and excellent low-temperature toughness, in which $vE_{-80}$ is 250 J or more, the CTOD value is 0.30 mm or more, and DWTT is −50° C. or lower. In particular, the hot rolled steel sheet has excellent CTOD characteristics and excellent DWTT characteristics. Furthermore, in each of the electric resistance welded steel pipes made from the hot rolled steel sheets of the examples, at both of the base metal and the seam portion, the CTOD value is 0.30 mm or more, and DWTT is −40° C. or lower. That is, the steel pipes have excellent low-temperature toughness.

In contrast, in the comparative examples outside our range, $vE_{-80}$ is less than 250 J, the CTOD value is less than 0.30 mm, or DWTT exceeds −50° C., deteriorating low-temperature toughness. Alternatively, the circularity of the pipe is degraded. For a comparative example (steel sheet 6), in which the cooling rate after the completion of the hot rolling is lower than our range and in which the coiling temperature is higher than our range, the difference ΔV of the fractions of the second phase exceeds 2%, so that the steel sheet has deteriorated low-temperature toughness. For a comparative example (steel sheet 3), in which the coiling temperature is lower than our range, the minimum lath spacing is less than 0.1 μm, the circularity is degraded. For a comparative example (steel sheet 11), in which the cooling stop temperature in the accelerated cooling is higher than our range and in which the coiling temperature is higher than our range, ΔD exceeds 2 μm, and ΔV exceeds 2%, so that the steel sheet has deteriorated low-temperature toughness. For a comparative example (steel sheet 16), in which the composition of the steel sheet does not satisfy expression (1), the base metal and the seam portion of the electric resistance welded steel pipe has deteriorated low-temperature toughness. For a comparative example (steel sheet 13), in which the cooling stop temperature in the accelerated cooling is higher than our range, ΔV exceeds 2%, so that the steel sheet has deteriorated low-temperature toughness. For a comparative example (steel sheet 15), in which the cooling rate in the accelerated cooling is lower than our range and in which the coiling temperature is lower than our range, ΔV exceeds 2%, so that the steel sheet has reduced low-temperature toughness.

INDUSTRIAL APPLICABILITY

It is possible to easily produce a thick-walled high-strength hot rolled steel sheet at low cost, the steel sheet having excellent low-temperature toughness, in particular, excellent DWTT characteristics and excellent CTOD characteristics, and good uniformity of the microstructure in the thickness direction, which is industrially extremely advantageous. Furthermore, it is possible to easily produce an electric resistance welded steel pipe and a spiral steel pipe for a transport pipe having excellent low-temperature toughness and excellent girth weldability in pipeline construction. Our discoveries can be applied to an electric resistance welded steel pipe for a transport pipe and a spiral steel pipe for a transport pipe for sour service.

In addition to the foregoing advantages, the steel sheet has only small nonuniformity of the material in the longitudinal direction and the width direction of the sheet, i.e., the steel sheet has excellent uniformity of the material.

In addition to the foregoing advantages, the steel sheet has excellent dimensional accuracy.

In addition to the foregoing advantages, the steel sheet has excellent pipe formability and excellent dimensional accuracy.

TABLE 1

| | Chemical composition (percent by mass) | | | | | | | | | | | | Left side value of | |
|---|---|---|---|---|---|---|---|---|---|---|---|---|---|---|
| Steel No. | C | Si | Mn | P | S | Al | Nb | Ti | N | O | V, Mo, Cr Cu, Ni | Ca | expression (1)* | Remarks |
| A | 0.041 | 0.20 | 1.60 | 0.015 | 0.0023 | 0.040 | 0.060 | 0.012 | 0.0026 | 0.0018 | — | — | 1.0 | Example |
| B | 0.037 | 0.19 | 1.59 | 0.016 | 0.0021 | 0.042 | 0.061 | 0.013 | 0.0028 | 0.0025 | — | 0.0021 | 1.2 | Example |
| C | 0.045 | 0.19 | 1.50 | 0.014 | 0.0023 | 0.038 | 0.055 | 0.009 | 0.0024 | 0.0023 | Cu: 0.15 Ni: 0.15 | — | 0.8 | Example |
| D | 0.044 | 0.22 | 1.62 | 0.01 | 0.001 | 0.038 | 0.059 | 0.011 | 0.0025 | 0.0023 | Cr: 0.30 | 0.0023 | 0.9 | Example |
| E | 0.035 | 0.23 | 1.61 | 0.012 | 0.0029 | 0.034 | 0.060 | 0.014 | 0.003 | 0.0025 | V: 0.057 Cu: 0.20 Ni: 0.20 | — | 1.3 | Example |
| F | 0.045 | 0.28 | 1.70 | 0.01 | 0.0015 | 0.045 | 0.065 | 0.025 | 0.0027 | 0.003 | Mo: 0.20 | 0.0023 | 1.3 | Example |
| G | 0.061 | 0.21 | 1.57 | 0.011 | 0.0016 | 0.034 | 0.072 | 0.019 | 0.0026 | 0.0023 | V: 0.049 Cu: 0.23 Ni: 0.26 Mo: 0.25 | — | 0.9 | Example |
| H | 0.020 | 0.55 | 1.00 | 0.015 | 0.0025 | 0.049 | 0.100 | 0.050 | 0.0032 | 0.0021 | — | — | 5.0 | Comparative Example |

*(1) Left side value = (Ti + Nb/2)/C

TABLE 2

| | | Hot rolling | | | | Cooling after hot rolling | | | | | | | |
|---|---|---|---|---|---|---|---|---|---|---|---|---|---|
| Steel sheet No. | Steel No. | Heating temperature (° C.) | Finish rolling start temperature (° C.) | Finish rolling end temperature (° C.) | Effective reduction rate (%) | Cooling start temperature* (° C.) | Cooling rate** (° C./s) | Cooling stop temperature*** (° C.) | Coiling Coiling temperature* (° C.) | BFS (° C.) | BFS0 (° C.) | Thickness (mm) | Remarks |
| 1 | A | 1205 | 980 | 790 | 66 | 787 | 54 | 545 | 580 | 565 | 646 | 12.7 | Example |
| 2 | A | 1208 | 980 | 790 | 62 | 788 | 26 | 520 | 540 | 607 | 646 | 14.5 | Example |
| 3 | A | 1198 | 980 | 790 | 54 | 789 | 14 | 600 | 600 | 625 | 646 | 25.4 | Example |
| 4 | A | 1203 | 980 | 790 | 53 | 788 | 35 | 605 | 640 | 594 | 646 | 22.2 | Comparative Example |
| 5 | A | 1207 | 980 | 790 | 53 | 788 | 5 | 620 | 630 | 639 | 646 | 22.2 | Comparative Example |
| 6 | B | 1210 | 970 | 795 | 58 | 793 | 21 | 560 | 540 | 617 | 648 | 14.5 | Example |
| 7 | B | 1205 | 970 | 795 | 51 | 793 | 25 | 540 | 520 | 611 | 648 | 17.5 | Example |
| 8 | B | 1204 | 970 | 795 | 53 | 793 | 12 | 635 | 670 | 630 | 648 | 22.2 | Comparative Example |
| 9 | C | 1203 | 980 | 785 | 58 | 782 | 18 | 560 | 590 | 613 | 640 | 17.5 | Example |
| 10 | D | 1202 | 980 | 785 | 58 | 783 | 22 | 540 | 570 | 589 | 622 | 17.5 | Example |
| 11 | E | 1200 | 960 | 790 | 58 | 788 | 18 | 550 | 580 | 604 | 631 | 17.5 | Example |
| 12 | F | 1210 | 960 | 800 | 58 | 797 | 37 | 510 | 500 | 549 | 604 | 17.5 | Example |

TABLE 2-continued

| Steel sheet No. | Steel No. | Hot rolling: Heating temperature (° C.) | Hot rolling: Finish rolling start temperature (° C.) | Hot rolling: Finish rolling end temperature (° C.) | Effective reduction rate (%) | Cooling after hot rolling: Cooling start temperature* (° C.) | Cooling after hot rolling: Cooling rate** (° C./s) | Cooling after hot rolling: Cooling stop temperature*** (° C.) | Coiling Coiling temperature* (° C.) | BFS (° C.) | BFS0 (° C.) | Thickness (mm) | Remarks |
|---|---|---|---|---|---|---|---|---|---|---|---|---|---|
| 13 | G | 1203 | 960 | 785 | 53 | 783 | 36 | 480 | 500 | 526 | 580 | 17.5 | Example |
| 14 | H | 1201 | 1050 | 850 | 45 | 848 | 25 | 590 | 620 | 657 | 694 | 17.5 | Comparative Example |

*Temperature at the middle position of the steel sheet in the thickness direction

**Average cooling rate in a temperature range of 750° C. to 650° C. at the middle position of the steel sheet in the thickness direction

***Temperature at the middle position of the steel sheet in the thickness direction

TABLE 3

| Steel sheet No. | Steel No. | Difference in microstructure of steel sheet in thickness direction*: Difference ΔD in average grain size of ferrite (μm) | Difference ΔV in fraction of second phase (%) | Tensile properties TS (MPa) | Low-temperature toughness: vE−80 (J) | Low-temperature toughness: DWTT (° C.) | Low-temperature toughness: CTOD value at −10° C. (mm) | Low-temperature toughness of steel pipe, Matrix portion: DWTT (° C.) | Matrix portion: CTOD value at −10° C. (mm) | Seam portion: CTOD value at −10° C. (mm) | Remarks |
|---|---|---|---|---|---|---|---|---|---|---|---|
| 1 | A | 1.7 | 1.5 | 638 | 375 | −60 | 0.92 | −40 | 0.91 | 0.95 | Example |
| 2 | A | 0.8 | 0.9 | 634 | 355 | −60 | 0.97 | −40 | 0.85 | 0.99 | Example |
| 3 | A | 1.7 | 1.5 | 618 | 365 | −45 | 0.56 | −20 | 0.65 | 0.60 | Example |
| 4 | A | 2.3 | 2.0 | 641 | 95 | −30 | 0.26 | −5 | 0.24 | 0.65 | Comparative Example |
| 5 | A | 1.8 | 3.0 | 620 | 34 | −20 | 0.22 | 5 | 0.21 | 0.59 | Comparative Example |
| 6 | B | 0.1 | 0.4 | 654 | 386 | −65 | 0.9 | −45 | 0.88 | 0.92 | Example |
| 7 | B | 0.2 | 0.3 | 650 | 371 | −55 | 0.95 | −35 | 0.87 | 0.81 | Example |
| 8 | B | 2.8 | 3.8 | 625 | 103 | −20 | 0.26 | 5 | 0.25 | 0.82 | Comparative Example |
| 9 | C | 0.2 | 1.3 | 633 | 334 | −55 | 0.6 | −35 | 0.59 | 0.62 | Example |
| 10 | D | 0.2 | 1.7 | 684 | 326 | −55 | 0.52 | −35 | 0.65 | 0.75 | Example |
| 11 | E | 1.4 | 0.5 | 715 | 328 | −45 | 0.97 | −25 | 0.85 | 0.57 | Example |
| 12 | F | 0.7 | 0.5 | 725 | 315 | −50 | 0.63 | −30 | 0.72 | 0.77 | Example |
| 13 | G | 0.3 | 1.8 | 787 | 309 | −45 | 0.79 | −25 | 0.57 | 0.68 | Example |
| 14 | H | 2.5 | 0.2 | 658 | 108 | −30 | 0.23 | −5 | 0.22 | 0.08 | Comparative Example |

*Difference in the microstructure between the position 1 mm from the surface of the steel sheet in the thickness direction and the middle position of the steel sheet in the thickness direction

TABLE 4

| Steel No. | Chemical composition (percent by mass): C | Si | Mn | P | S | Al | Nb | Ti | N | O | V, Cr, Cu Ni, Mo | Ca | Left side value of expression (1)* | Remarks |
|---|---|---|---|---|---|---|---|---|---|---|---|---|---|---|
| A | 0.043 | 0.21 | 1.62 | 0.016 | 0.0022 | 0.035 | 0.061 | 0.013 | 0.0025 | 0.0032 | — | — | 1 | Example |
| B | 0.036 | 0.21 | 1.58 | 0.016 | 0.0019 | 0.039 | 0.059 | 0.015 | 0.0027 | 0.003 | — | 0.0023 | 1.2 | Example |
| C | 0.041 | 0.2 | 1.49 | 0.015 | 0.0021 | 0.035 | 0.054 | 0.008 | 0.0029 | 0.0031 | Cu: 0.15 Ni: 0.15 | — | 0.9 | Example |
| D | 0.051 | 0.23 | 1.62 | 0.01 | 0.001 | 0.035 | 0.063 | 0.012 | 0.0035 | 0.0027 | Cr: 0.30 | 0.0022 | 0.9 | Example |
| E | 0.075 | 0.24 | 1.63 | 0.015 | 0.0027 | 0.038 | 0.059 | 0.011 | 0.0037 | 0.0032 | V: 0.049 | — | 0.5 | Example |

TABLE 4-continued

| Steel No. | Chemical composition (percent by mass) C | Si | Mn | P | S | Al | Nb | Ti | N | O | V, Cr, Cu Ni, Mo | Ca | Left side value of expression (1)* | Remarks |
|---|---|---|---|---|---|---|---|---|---|---|---|---|---|---|
| F | 0.034 | 0.22 | 1.61 | 0.015 | 0.0028 | 0.03 | 0.061 | 0.014 | 0.0033 | 0.0035 | V: 0.057<br>Cu: 0.21<br>Ni: 0.22 | — | 1.3 | Example |
| G | 0.046 | 0.27 | 1.7 | 0.012 | 0.0015 | 0.035 | 0.065 | 0.025 | 0.0026 | 0.0028 | Mo: 0.19 | 0.002 | 1.3 | Example |
| H | 0.069 | 0.27 | 1.65 | 0.018 | 0.0016 | 0.035 | 0.072 | 0.019 | 0.003 | 0.0039 | V: 0.051<br>Cu: 0.22<br>Ni: 0.23<br>Mo: 0.23 | — | 0.8 | Example |
| I | 0.016 | 0.7 | 0.78 | 0.003 | 0.0022 | 0.048 | 0.22 | 0.01 | 0.0038 | 0.0038 | — | — | 7.5 | Comparative Example |

*(1) Left side value = (Ti + Nb/2)/C

TABLE 5

| Steel sheet No. | Steel No. | Hot rolling: Heating temperature (° C.) | Rough scale breaker | Finish scale breaker | Finish entry temperature FET (° C.) | Finish delivery temperature FDT (° C.) | Effective reduction rate (%) | Cooling after hot rolling: Cooling start temperature* (° C.) | Cooling rate** (° C./s) | Cooling stop temperature* (° C.) | Coiling Coiling temperature* (° C.) | BFS (° C.) | BFS0 (° C.) | Thickness (mm) | Remarks |
|---|---|---|---|---|---|---|---|---|---|---|---|---|---|---|---|
| 1 | A | 1200 | used | used | 970 | 795 | 66 | 790 | 51 | 530 | 525 | 568 | 644 | 12.7 | Example |
| 2 | A | 1200 | used | used | 980 | 790 | 62 | 780 | 26 | 520 | 515 | 605 | 644 | 14.5 | Example |
| 3 | A | 1210 | used | used | 980 | 790 | 54 | 785 | 9 | 610 | 645 | 631 | 644 | 25.4 | Comparative Example |
| 4 | A | 1230 | used | used | 980 | 790 | 53 | 780 | 35 | 600 | 610 | 592 | 644 | 22.2 | Comparative Example |
| 5 | A | 1200 | used | used | 980 | 790 | 53 | 780 | 5 | 600 | 590 | 637 | 644 | 22.2 | Comparative Example |
| 6 | B | 1220 | used | used | 970 | 795 | 58 | 790 | 21 | 562 | 540 | 618 | 649 | 14.5 | Example |
| 7 | B | 1220 | unused | used | 970 | 795 | 51 | 790 | 25 | 540 | 520 | 611 | 648 | 17.5 | Comparative Example |
| 8 | B | 1220 | used | unused | 970 | 795 | 53 | 790 | 43 | 580 | 655 | 584 | 648 | 22.2 | Comparative Example |
| 9 | C | 1200 | used | used | 980 | 785 | 58 | 780 | 18 | 560 | 590 | 614 | 641 | 17.5 | Example |
| 10 | D | 1200 | used | used | 980 | 785 | 58 | 785 | 22 | 540 | 570 | 587 | 620 | 17.5 | Example |
| 11 | E | 1200 | used | used | 960 | 790 | 58 | 780 | 18 | 550 | 580 | 606 | 633 | 17.5 | Example |
| 12 | F | 1200 | used | used | 960 | 800 | 58 | 790 | 37 | 510 | 500 | 575 | 630 | 17.5 | Example |
| 13 | G | 1200 | used | used | 960 | 785 | 53 | 780 | 36 | 480 | 500 | 551 | 605 | 17.5 | Example |
| 14 | H | 1200 | used | used | 880 | 785 | 45 | 775 | 32 | 450 | 445 | 529 | 577 | 25.4 | Example |
| 15 | I | 1230 | used | used | 1050 | 850 | 45 | 840 | 25 | 590 | 620 | 674 | 711 | 17.5 | Comparative Example |

*Temperature at the middle position of the steel sheet in the thickness direction

**Average cooling rate in a temperature range of 750° C. to 650° C. at the middle position of the steel sheet in the thickness direction

TABLE 6

| Steel sheet No. | Steel No. | Mill scale: Average thickness of mill scale ts (μm) | Mill scale: Δts (μm) | Difference in microstructure of steel sheet in thickness direction*: Difference ΔD in average grain size of ferrite (μm) | Difference in microstructure of steel sheet in thickness direction*: Difference ΔV in fraction of second phase (%) | Tensile properties: TS (MPa) | Tensile properties: ΔTS (MPa) | Low-temperature toughness: $vE_{-80}$ (J) | Low-temperature toughness: $\Delta vE_{-80}$ (J) |
|---|---|---|---|---|---|---|---|---|---|
| 1 | A | 10 | 3 | 1.7 | 1.5 | 637 | 11 | 375 | 16 |
| 2 | A | 9 | 2 | 0.8 | 0.9 | 635 | 11 | 355 | 15 |
| 3 | A | 2 | 3 | 1.8 | 2.4 | 619 | 10 | 225 | 3 |
| 4 | A | 32 | 20 | 2.3 | 2.0 | 643 | 38 | 95 | 46 |
| 5 | A | 11 | 3 | 1.8 | 3.0 | 618 | 11 | 34 | 17 |
| 6 | B | 9 | 3 | 0.1 | 0.4 | 655 | 11 | 386 | 15 |
| 7 | B | 31 | 18 | 1.7 | 0.3 | 649 | 35 | 295 | 43 |
| 8 | B | 35 | 22 | 2.8 | 3.8 | 626 | 51 | 103 | 58 |
| 9 | C | 20 | 8 | 0.2 | 1.3 | 635 | 14 | 334 | 24 |
| 10 | D | 16 | 5 | 0.2 | 1.7 | 683 | 12 | 326 | 21 |
| 11 | E | 14 | 3 | 1.4 | 0.5 | 669 | 11 | 300 | 19 |
| 12 | F | 9 | 5 | 0.7 | 0.5 | 716 | 11 | 328 | 15 |
| 13 | G | 20 | 10 | 0.3 | 1.8 | 724 | 14 | 315 | 24 |
| 14 | H | 7 | 5 | 0.3 | 0.4 | 781 | 10 | 309 | 13 |
| 15 | I | 21 | 11 | 2.5 | 0.2 | 661 | 15 | 108 | 24 |

| Steel sheet No. | Low-temperature toughness: DWTT (° C.) | Low-temperature toughness: CTOD value at −10° C. (mm) | Low-temperature toughness of steel pipe: Base metal: DWTT (° C.) | Low-temperature toughness of steel pipe: Base metal: CTOD value at −10° C. (mm) | Low-temperature toughness of steel pipe: Seam portion: CTOD value at −10° C. (mm) | Remarks |
|---|---|---|---|---|---|---|
| 1 | −60 | 0.92 | −40 | 0.89 | 0.95 | Example |
| 2 | −60 | 0.97 | −40 | 0.82 | 0.98 | Example |
| 3 | −30 | 0.56 | −20 | 0.64 | 0.59 | Comparative Example |
| 4 | −30 | 0.26 | −5 | 0.23 | 0.64 | Comparative Example |
| 5 | −20 | 0.22 | 5 | 0.20 | 0.60 | Comparative Example |
| 6 | −65 | 0.90 | −45 | 0.87 | 0.91 | Example |
| 7 | −35 | 0.95 | −15 | 0.86 | 0.83 | Comparative Example |
| 8 | −20 | 0.26 | 5 | 0.24 | 0.78 | Comparative Example |
| 9 | −55 | 0.60 | −35 | 0.55 | 0.59 | Example |
| 10 | −55 | 0.52 | −35 | 0.48 | 0.78 | Example |
| 11 | −40 | 0.85 | −25 | 0.65 | 0.46 | Example |
| 12 | −45 | 0.97 | −25 | 0.84 | 0.67 | Example |
| 13 | −50 | 0.63 | −30 | 0.73 | 0.76 | Example |
| 14 | −45 | 0.79 | −25 | 0.56 | 0.61 | Example |
| 15 | −30 | 0.23 | −10 | 0.19 | 0.08 | Comparative Example |

*Difference in the microstructure between the position 1 mm from the surface of the steel sheet in the thickness direction and the middle position of the steel sheet in the thickness direction

TABLE 7

| Steel No. | Chemical composition (percent by mass) C | Si | Mn | P | S | Al | Nb | Ti | N | O | V, Mo, Cr, Cu, Ni | Ca | Ceq** | Left side value of expression (1)* | Remarks |
|---|---|---|---|---|---|---|---|---|---|---|---|---|---|---|---|
| A | 0.043 | 0.21 | 0.93 | 0.016 | 0.0022 | 0.035 | 0.045 | 0.009 | 0.0033 | 0.0029 | Mo: 0.18 | — | 0.234 | 0.7 | Example |
| B | 0.036 | 0.21 | 1.43 | 0.016 | 0.0019 | 0.039 | 0.059 | 0.015 | 0.0036 | 0.0028 | — | 0.0023 | 0.274 | 1.2 | Example |
| C | 0.062 | 0.2 | 1.61 | 0.015 | 0.0021 | 0.035 | 0.061 | 0.013 | 0.003 | 0.0031 | — | — | 0.33 | 0.7 | Example |
| D | 0.049 | 0.23 | 1.45 | 0.010 | 0.0010 | 0.035 | 0.063 | 0.012 | 0.0041 | 0.0029 | Mo: 0.16<br>Ni: 0.24<br>Cu: 0.23 | — | 0.354 | 0.9 | Example |
| E | 0.043 | 0.22 | 1.64 | 0.015 | 0.0027 | 0.038 | 0.059 | 0.011 | 0.0042 | 0.0033 | Mo: 0.16<br>Ni: 0.24<br>Cu: 0.23 | 0.0022 | 0.372 | 0.9 | Example |
| F | 0.049 | 0.22 | 1.61 | 0.015 | 0.0028 | 0.030 | 0.061 | 0.014 | 0.0028 | 0.0027 | Mo: 0.16<br>Nl: 0.18<br>Cu: 0.18 | — | 0.379 | 0.9 | Example |
| G | 0.039 | 0.27 | 1.63 | 0.012 | 0.0015 | 0.035 | 0.065 | 0.011 | 0.0035 | 0.0033 | Cr: 0.31 | — | 0.406 | 1.1 | Example |
| H | 0.069 | 0.27 | 1.84 | 0.018 | 0.0016 | 0.035 | 0.071 | 0.019 | 0.0034 | 0.0027 | V: 0.059<br>Mo: 0.25<br>Ni: 0.25<br>Cu: 0.25 | 0.002 | 0.496 | 0.8 | Example |
| I | 0.016 | 0.7 | 1.25 | 0.003 | 0.0022 | 0.048 | 0.15 | 0.030 | 0.003 | 0.0032 | V: 0.044<br>Mo: 0.23<br>Cr: 0.18<br>Ni: 0.21<br>Cu: 0.24 | 0.0018 | 0.224 | 6.6 | Comparative Example |

*(1) Left side value = (Ti + Nb/2)/C

**Ceq (%) = C + Mn/6 + (Cr + Mo + V)/5 + (Ni + Cu)/15

TABLE 8

| Steel sheet No. | Steel No. | Hot rolling: Heating temperature (° C.) | Finish entry temperature FET* (° C.) | Finish delivery temperature FDT* (° C.) | Effective reduction rate (%) | Cooling after hot rolling: Cooling start temperature* (° C.) | Cooling rate at position 1 mm from surface (° C./s) | Cooling rate at middle position in thickness direction** (° C./s) | Cooling stop temperature* (° C.) | Coiling Coiling temperature* (° C.) | BFS (° C.) | BFS0 (° C.) | Thickness (mm) | Remarks |
|---|---|---|---|---|---|---|---|---|---|---|---|---|---|---|
| 1 | A | 1200 | 1020 | 810 | 64 | 808 | 190 | 48 | 470 | 455 | 589 | 661 | 12.7 | Example |
| 2 | A | 1200 | 1030 | 800 | 59 | 798 | 91 | 20 | 500 | 495 | 631 | 661 | 25.4 | Example |
| 3 | A | 1210 | 1030 | 805 | 52 | 803 | 7 | 3 | 620 | 610 | 657 | 661 | 25.4 | Comparative Example |
| 4 | B | 1220 | 1020 | 810 | 53 | 808 | 166 | 41 | 560 | 540 | 600 | 661 | 14.5 | Example |
| 5 | B | 1220 | 1020 | 810 | 58 | 808 | 192 | 32 | 500 | 480 | 613 | 661 | 25.4 | Example |
| 6 | B | 1220 | 1020 | 810 | 56 | 808 | 383 | 52 | 650 | 670 | 583 | 661 | 22.2 | Comparative Example |
| 7 | C | 1200 | 1030 | 800 | 54 | 798 | 100 | 27 | 520 | 500 | 599 | 639 | 17.5 | Example |
| 8 | D | 1200 | 1030 | 805 | 54 | 803 | 192 | 32 | 540 | 570 | 560 | 608 | 25.4 | Example |
| 9 | E | 1200 | 1010 | 800 | 58 | 798 | 58 | 19 | 550 | 580 | 573 | 601 | 17.5 | Example |
| 10 | F | 1200 | 1010 | 810 | 53 | 808 | 170 | 45 | 470 | 465 | 554 | 621 | 12.7 | Example |
| 11 | F | 1200 | 1010 | 815 | 52 | 807 | 322 | 60 | 510 | 500 | 531 | 621 | 14.5 | Comparative Example |
| 12 | G | 1200 | 1010 | 800 | 45 | 798 | 161 | 36 | 480 | 500 | 528 | 582 | 17.5 | Example |
| 13 | G | 1200 | 1010 | 800 | 45 | 798 | 42 | 19 | 540 | 600 | 554 | 582 | 12.7 | Comparative Example |
| 14 | H | 1220 | 930 | 795 | 46 | 793 | 129 | 25 | 450 | 445 | 514 | 551 | 25.4 | Example |
| 15 | H | 1220 | 930 | 795 | 46 | 793 | 173 | 30 | 520 | 530 | 506 | 551 | 25.4 | Comparative Example |
| 16 | I | 1230 | 1100 | 860 | 55 | 858 | 119 | 30 | 590 | 620 | 633 | 678 | 17.5 | Comparative Example |

*Temperature at the middle position of the steel sheet in the thickness direction

**Average cooling rate in a temperature range of 750° C. to 650° C. at the middle position of the steel sheet in the thickness direction

TABLE 9

| Steel sheet No. | Steel No. | Difference in microstructure of steel sheet in thickness direction*: Difference ΔD in average grain size of ferrite (μm) | Difference ΔV in fraction of second phase (%) | Difference ΔHV** in hardness | Tensile properties TS (MPa) | Low-temperature toughness: vE−80 (J) | DWTT (° C.) | CTOD value at −10° C. (mm) | Circularity of steel pipe (%) | Low-temperature toughness of steel pipe, Base metal: DWTT (° C.) | CTOD value at −10° C. (mm) | Seam portion: CTOD value at −10° C. (mm) | Remarks |
|---|---|---|---|---|---|---|---|---|---|---|---|---|---|
| 1 | A | 0.2 | 0.1 | 26 | 572 | 368 | −55 | 1.13 | 0.70 | −35 | 0.95 | 0.94 | Example |
| 2 | A | 0.3 | 0.5 | 14 | 568 | 354 | −55 | 0.96 | 0.74 | −35 | 0.87 | 0.81 | Example |
| 3 | A | 1.2 | 4.5 | 21 | 559 | 87 | −25 | 0.58 | 0.72 | 0 | 0.63 | 0.35 | Comparative Example |
| 4 | B | 0.9 | 1.4 | 38 | 561 | 327 | −60 | 0.78 | 0.76 | −35 | 0.87 | 0.76 | Example |
| 5 | B | 1.8 | 1.4 | 29 | 565 | 310 | −60 | 0.81 | 0.74 | −35 | 0.97 | 0.82 | Example |
| 6 | B | 2.7 | 3.7 | 21 | 576 | 136 | −30 | 0.9 | 0.76 | −5 | 0.87 | 0.96 | Comparative Example |
| 7 | C | 1.0 | 0.3 | 37 | 627 | 272 | −60 | 0.94 | 0.73 | −35 | 0.85 | 0.82 | Example |
| 8 | D | 1.7 | 1.4 | 39 | 665 | 280 | −60 | 0.87 | 0.75 | −35 | 0.96 | 0.76 | Example |
| 9 | E | 1.9 | 2.0 | 27 | 689 | 263 | −55 | 0.92 | 0.74 | −30 | 0.75 | 0.67 | Example |
| 10 | F | 0.2 | 0.1 | 41 | 675 | 259 | −55 | 0.86 | 0.75 | −30 | 0.68 | 0.78 | Example |
| 11 | F | 0.2 | 0.2 | 62 | 669 | 245 | −55 | 0.85 | 0.90 | −30 | 0.65 | 0.78 | Comparative Example |
| 12 | G | 0.4 | 0.1 | 39 | 693 | 227 | −60 | 0.95 | 0.75 | −35 | 0.85 | 0.65 | Example |
| 13 | G | 0.4 | 2.5 | 27 | 699 | 104 | −30 | 0.63 | 0.76 | −10 | 0.72 | 0.75 | Comparative Example |
| 14 | H | 0.3 | 0.4 | 35 | 712 | 285 | −45 | 0.79 | 0.76 | −20 | 0.78 | 0.81 | Example |
| 15 | H | 2.5 | 1.5 | 39 | 709 | 165 | −30 | 0.75 | 0.75 | −5 | 0.89 | 0.76 | Comparative Example |
| 16 | I | 0.2 | 0.1 | 13 | 675 | 326 | −60 | 0.86 | 0.75 | −35 | 0.78 | 0.08 | Comparative Example |

*Difference in the microstructure between the position 1 mm from the surface of the steel sheet in the thickness direction and the middle position of the steel sheet in the thickness direction

**Difference in hardness between the position 1 mm from the surface of the steel sheet in the thickness direction and the middle position of the steel sheet in the thickness direction

TABLE 10

| Steel No. | Chemical composition (percent by mass): C | Si | Mn | P | S | Al | Nb | Ti | N | O | V, Mo, Cr, Cu, Ni | Ca | Ceq** | Left side value of expression (1)* | Remarks |
|---|---|---|---|---|---|---|---|---|---|---|---|---|---|---|---|
| A | 0.042 | 0.22 | 0.98 | 0.017 | 0.0023 | 0.034 | 0.044 | 0.010 | 0.0022 | 0.0031 | Mo: 0.17 | — | 0.239 | 0.8 | Example |
| B | 0.037 | 0.19 | 1.42 | 0.015 | 0.0018 | 0.038 | 0.061 | 0.014 | 0.0025 | 0.0032 | — | 0.0023 | 0.274 | 1.2 | Example |
| C | 0.061 | 0.21 | 1.59 | 0.019 | 0.0025 | 0.034 | 0.059 | 0.012 | 0.0023 | 0.0032 | — | — | 0.326 | 0.7 | Example |
| D | 0.051 | 0.22 | 1.46 | 0.016 | 0.0012 | 0.041 | 0.062 | 0.013 | 0.0027 | 0.0029 | Mo: 0.14<br>Ni: 0.21<br>Cu: 0.21 | 0.0021 | 0.350 | 0.9 | Example |
| E | 0.042 | 0.25 | 1.65 | 0.013 | 0.0029 | 0.034 | 0.058 | 0.012 | 0.0033 | 0.0035 | Mo: 0.18<br>Cu: 0.17<br>Ni: 0.17 | — | 0.376 | 1.0 | Example |
| F | 0.049 | 0.23 | 1.60 | 0.014 | 0.0023 | 0.033 | 0.062 | 0.015 | 0.0029 | 0.0029 | Cr: 0.31 | — | 0.378 | 0.9 | Example |
| G | 0.041 | 0.29 | 1.62 | 0.016 | 0.0014 | 0.034 | 0.061 | 0.015 | 0.0028 | 0.0029 | Mo: 0.26<br>V: 0.061<br>Ni: 0.24<br>Cu: 0.24 | 0.0028 | 0.407 | 1.1 | Example |
| H | 0.072 | 0.26 | 1.85 | 0.019 | 0.0025 | 0.036 | 0.073 | 0.018 | 0.0035 | 0.0031 | V: 0.045<br>Mo: 0.24<br>Cr: 0.19<br>Cu: 0.23<br>Ni: 0.22 | 0.0018 | 0.505 | 0.8 | Example |

TABLE 10-continued

| Steel No. | Chemical composition (percent by mass) C | Si | Mn | P | S | Al | Nb | Ti | N | O | V, Mo, Cr, Cu, Ni | Ca | Ceq** | Left side value of expression (1)* | Remarks |
|---|---|---|---|---|---|---|---|---|---|---|---|---|---|---|---|
| I | 0.017 | 0.69 | 1.27 | 0.012 | 0.0023 | 0.049 | 0.14 | 0.032 | 0.0028 | 0.0034 | — | — | 0.229 | 6.0 | Comparative Example |

*(1) Left side value = (Ti + Nb/2)/C

**Ceq (%) = C + Mn/6 + (Cr + Mo + V)/5 + (Ni + Cu)/15

TABLE 11

| Steel sheet No. | Steel No. | Hot rolling: Heating temperature (° C.) | Finish entry temperature FET* (° C.) | Finish delivery temperature FDT* (° C.) | Effective reduction rate (%) | Cooling after hot rolling: Cooling start temperature* (° C.) | Cooling rate at position 1 mm from surface (° C./s) | Cooling rate at middle position in thickness direction** (° C./s) | Cooling stop temperature* (° C.) | Coiling Coiling temperature* (° C.) | BFS (° C.) | BFS0 (° C.) | Thickness (mm) | Remarks |
|---|---|---|---|---|---|---|---|---|---|---|---|---|---|---|
| 1 | A | 1200 | 1020 | 810 | 63 | 803 | 711 | 100 | 470 | 455 | 511 | 661 | 1.2.7 | Example |
| 2 | A | 1200 | 1030 | 800 | 60 | 798 | 223 | 35 | 430 | 430 | 609 | 661 | 25.4 | Example |
| 3 | A | 1210 | 1030 | 805 | 51 | 803 | 223 | 35 | 200 | 220 | 609 | 661 | 25.4 | Comparative Example |
| 4 | B | 1220 | 1020 | 810 | 54 | 808 | 341 | 62 | 320 | 350 | 568 | 661 | 14.5 | Example |
| 5 | B | 1220 | 1020 | 810 | 57 | 808 | 267 | 39 | 420 | 410 | 603 | 661 | 25.4 | Example |
| 6 | B | 1220 | 1020 | 810 | 55 | 808 | 7 | 3 | 650 | 670 | 657 | 661 | 22.2 | Comparative Example |
| 7 | C | 1200 | 1030 | 800 | 53 | 798 | 235 | 45 | 360 | 400 | 572 | 639 | 17.5 | Example |
| 8 | D | 1200 | 1030 | 805 | 52 | 803 | 341 | 45 | 490 | 470 | 541 | 608 | 25.4 | Example |
| 9 | E | 1200 | 1010 | 800 | 59 | 798 | 282 | 50 | 480 | 460 | 526 | 601 | 17.5 | Example |
| 10 | F | 120 | 1010 | 810 | 52 | 808 | 586 | 90 | 470 | 465 | 486 | 621 | 12.7 | Example |
| 11 | F | 1200 | 1010 | 815 | 50 | 807 | 233 | 50 | 570 | 690 | 546 | 621 | 14.5 | Comparative Example |
| 12 | G | 1200 | 1010 | 800 | 44 | 798 | 209 | 42 | 480 | 500 | 519 | 582 | 17.5 | Example |
| 13 | G | 1200 | 1010 | 800 | 43 | 798 | 371 | 70 | 600 | 580 | 477 | 582 | 12.7 | Comparative Example |
| 14 | H | 1220 | 930 | 795 | 45 | 793 | 395 | 49 | 450 | 445 | 478 | 551 | 25.4 | Example |
| 15 | H | 1220 | 930 | 795 | 47 | 793 | 7 | 3 | 220 | 200 | 547 | 551 | 25.4 | Comparative Example |
| 16 | I | 1230 | 1100 | 860 | 56 | 858 | 119 | 30 | 460 | 450 | 633 | 678 | 17.5 | Comparative Example |

*Temperature at the middle position of the steel sheet in the thickness direction

**Average cooling rate in a temperature range of 750° C. to 650° C. at the middle position of the steel sheet in the thickness direction

TABLE 12

| Steel sheet No. | Steel No. | Difference in microstructure of steel sheet in thickness direction*: Difference ΔD in average grain size of ferrite (μm) | Difference ΔV in fraction of second phase (%) | Minimum lath spacing** (μm) | Tensile properties TS (MPa) | Low-temperature toughness: vE−80 (J) | DWTT (° C.) | CTOD value at −10° C. (mm) | Circularity of steel pipe (%) | Low-temperature toughness of steel pipe: Base metal DWTT (° C.) | Base metal CTOD value at −10° C. (mm) | Seam portion CTOD value at −10° C. (mm) | Remarks |
|---|---|---|---|---|---|---|---|---|---|---|---|---|---|
| 1 | A | 0.2 | 0.1 | 0.3 | 581 | 367 | −80 | 1.02 | 0.79 | −60 | 1.09 | 0.98 | Example |
| 2 | A | 0.1 | 0.2 | 0.3 | 577 | 365 | −65 | 0.98 | 0.78 | −45 | 0.97 | 0.89 | Example |

TABLE 12-continued

| Steel sheet No. | Steel No. | Difference in microstructure of steel sheet in thickness direction*: Difference ΔD in average grain size of ferrite (μm) | Difference ΔV in fraction of second phase (%) | Minimum lath spacing** (μm) | Tensile properties TS (MPa) | Low-temperature toughness: vE−80 (J) | DWTT (° C.) | CTOD value at −10° C. (mm) | Circularity of steel pipe (%) | Low-temperature toughness of steel pipe, Base metal: DWTT (° C.) | CTOD value at −10° C. (mm) | Seam portion: CTOD value at −10° C. (mm) | Remarks |
|---|---|---|---|---|---|---|---|---|---|---|---|---|---|
| 3 | A | 0.1 | 0.2 | 0.08 | 583 | 367 | −65 | 0.68 | 0.94 | −40 | 0.66 | 0.5 | Comparative Example |
| 4 | B | 0.2 | 0.1 | 0.3 | 570 | 327 | −75 | 0.77 | 0.72 | −50 | 0.96 | 0.77 | Example |
| 5 | B | 0.2 | 0.2 | 0.2 | 574 | 310 | −70 | 0.82 | 0.79 | −45 | 1.06 | 0.88 | Example |
| 6 | B | 2.0 | 3.8 | —*** | 584 | 78 | −20 | 0.32 | 0.86 | 5 | 1.03 | 1.12 | Comparative Example |
| 7 | C | 0.1 | 0.1 | 0.2 | 636 | 278 | −70 | 0.93 | 0.79 | −45 | 0.86 | 0.83 | Example |
| 8 | D | 0.1 | 0.2 | 0.3 | 674 | 295 | −70 | 0.85 | 0.83 | −45 | 1.06 | 0.9 | Example |
| 9 | E | 0.2 | 0.1 | 0.3 | 698 | 278 | −65 | 0.90 | 0.85 | −40 | 0.84 | 0.82 | Example |
| 10 | F | 0.2 | 0.2 | 0.4 | 684 | 265 | −65 | 0.88 | 0.92 | −40 | 0.83 | 0.88 | Example |
| 11 | F | 2.9 | 4.0 | 0.3 | 678 | 69 | −20 | 0.81 | 0.76 | 5 | 0.72 | 0.88 | Comparative Example |
| 12 | G | 0.1 | 0.1 | 0.4 | 704 | 275 | −65 | 0.67 | 0.89 | −40 | 0.86 | 0.65 | Example |
| 13 | G | 1.7 | 3.8 | 0.3 | 708 | 108 | −30 | 0.79 | 0.75 | −5 | 0.74 | 0.83 | Comparative Example |
| 14 | H | 0.1 | 0.1 | 0.4 | 721 | 286 | −65 | 0.74 | 0.86 | −40 | 0.84 | 0.83 | Example |
| 15 | H | 0.6 | 3.6 | 0.3 | 708 | 89 | −25 | 0.75 | 0.85 | 0 | 1.02 | 0.82 | Comparative Example |
| 16 | I | 0.1 | 0.2 | 0.4 | 684 | 327 | −60 | 0.92 | 0.74 | −35 | 0.90 | 0.09 | Comparative Example |

*Difference in the microstructure between the position 1 mm from the surface of the steel sheet in the thickness direction and the middle position of the steel sheet in the thickness direction

**Lath spacing of bainite or quenched martensite at the position 1 mm from the surface of the steel sheet

***Lath is not formed

The invention claimed is:

1. A method of producing a thick-walled high-strength hot rolled steel sheet comprising:

heating a steel material containing, on a mass percent basis, 0.02%-0.08% C, 0.01%-0.50% Si, 0.5%-1.8% Mn, 0.025% or less P, 0.005% or less S, 0.005%-0.10% Al, 0.01%-0.10% Nb, 0.001%-0.05% Ti, the balance being Fe, and incidental impurities, C, Ti, and Nb being contained to satisfy expression (1):

$$(Ti+(Nb/2))/C<4 \quad (1);$$

performing hot rolling including rough rolling and finish rolling;

performing accelerated cooling at an average cooling rate of 100° C./s or more at a position 1 mm from a surface of the steel sheet in the thickness direction and at an average cooling rate of 10° C./s or more at a middle position of the steel sheet in the thickness direction to a cooling stop temperature of BFS or lower at a middle position of the steel sheet in the thickness direction, wherein BFS is defined by expression (2):

$$BFS\ (°\ C.)=770-300C-70Mn-70Cr-170Mo-40Cu-40Ni-1.5CR \quad (2);$$

and performing coiling at a coiling temperature of BFS0 or lower at the middle position of the steel sheet in the thickness direction, the BFS0 being defined by expression (3):

$$BFS0\ (°\ C.)=770-300C-70Mn-70Cr-170Mo-40Cu-40Ni \quad (3)$$

where in expressions (1), (2), and (3), C, Ti, Nb, Mn, Cr, Mo, Cu, and Ni each represent a proportion (percent by mass) thereof, and CR represents a cooling rate (° C./s) at the middle position of the steel sheet in the thickness direction.

2. The method according to claim 1, further comprising:

performing scale removal treatment with a scale breaker before the rough rolling and before the finish rolling, wherein in the hot rolling, the finish entry temperature (FET) is 800° C. to 1050° C., and finish delivery temperature (FDT) is 750° C. to 950° C.

3. The method according to claim 1, wherein, in the accelerated cooling, when a carbon equivalent Ceq is 0.37% or less, an average cooling rate at a position 1 mm from a surface of the steel sheet in the thickness direction is 10° C./s or more, and when the carbon equivalent Ceq exceeds 0.37%, the average cooling rate is 10 to 200° C./s, the carbon equivalent Ceq is defined by expression (4):

$$Ceq\ (\%)=C+Mn/6+(Cr+Mo+V)/5+(Ni+Cu)/15 \quad (4)$$

where C, Ti, Mn, Cr, Mo, V, Cu, and Ni each represent the proportion thereof (percent by mass).

4. The method according to claim 1, wherein the coiling is performed at a coiling temperature of 300° C. or higher at a middle position of the steel sheet in the thickness direction.

5. The method according to claim 1, further comprising, on a mass percent basis, one or more selected from the group consisting of 0.01%-0.10% V, 0.01%-0.50% Mo, 0.01%-1.0% Cr, 0.01%-0.50% Cu, and 0.01%-0.50% Ni.

6. The method according to claim 1, further comprising, on a mass percent basis, 0.0005%-0.005% Ca.

7. The method according to claim 2, further comprising, on a mass percent basis, one or more selected from the group consisting of 0.01%-0.10% V, 0.01%-0.50% Mo, 0.01%-1.0% Cr, 0.01%-0.50% Cu, and 0.01%-0.50% Ni.

8. The method according to claim 3, further comprising, on a mass percent basis, one or more selected from the group consisting of 0.01%-0.10% V, 0.01%-0.50% Mo, 0.01%-1.0% Cr, 0.01%-0.50% Cu, and 0.01%-0.50% Ni.

9. The method according to claim 4, further comprising, on a mass percent basis, one or more selected from the group consisting of 0.01%-0.10% V, 0.01%-0.50% Mo, 0.01%-1.0% Cr, 0.01%-0.50% Cu, and 0.01%-0.50% Ni.

10. The method according to claim 2, further comprising, on a mass percent basis, 0.0005%-0.005% Ca.

11. The method according to claim 3, further comprising, on a mass percent basis, 0.0005%-0.005% Ca.

12. The method according to claim 4, further comprising, on a mass percent basis, 0.0005%-0.005% Ca.

13. The method according to claim 5, further comprising, on a mass percent basis, 0.0005%-0.005% Ca.

14. The method according to claim 7, further comprising, on a mass percent basis, 0.0005%-0.005% Ca.

15. The method according to claim 8, further comprising, on a mass percent basis, 0.0005%-0.005% Ca.

16. The method according to claim 9, further comprising, on a mass percent basis, 0.0005%-0.005% Ca.

* * * * *